US007327315B2

(12) United States Patent
Starkie et al.

(10) Patent No.: US 7,327,315 B2
(45) Date of Patent: Feb. 5, 2008

(54) ULTRAWIDEBAND ANTENNA

(75) Inventors: Timothy John Stefan Starkie, Cambridge (GB); Leslie David Smith, Ely (GB)

(73) Assignee: Artimi Ltd., Cambridgeshire (GB)

( * ) Notice: Subject to any disclaimer, the term of this patent is extended or adjusted under 35 U.S.C. 154(b) by 173 days.

(21) Appl. No.: 10/931,217

(22) Filed: Sep. 1, 2004

(65) Prior Publication Data

US 2005/0110687 A1 May 26, 2005

Related U.S. Application Data

(63) Continuation-in-part of application No. PCT/GB03/05070, filed on Nov. 21, 2003.

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/769, 793, 846, 873, 900
See application file for complete search history.

(56) References Cited

U.S. PATENT DOCUMENTS

| | | | |
|---|---|---|---|
| 3,364,491 | A | 1/1968 | Stohr |
| 3,728,632 | A | 4/1973 | Ross |
| 5,255,002 | A | 10/1993 | Day |
| 5,319,377 | A | 6/1994 | Thomas et al. |
| 5,323,169 | A | 6/1994 | Koslover |
| 5,351,063 | A | 9/1994 | Kim et al. |
| 5,365,242 | A | 11/1994 | Shiina |
| H1773 | H | 1/1999 | Cheston et al. |
| 5,923,299 | A | 7/1999 | Brown et al. |
| 5,973,653 | A | 10/1999 | Kragalott et al. |
| 6,218,997 | B1 | 4/2001 | Lindenmeier et al. |
| 6,351,246 | B1 | 2/2002 | McCorkle |
| 6,400,329 | B1 | 6/2002 | Barnes |
| 6,437,756 | B1 | 8/2002 | Schantz |
| 6,512,488 | B2 | 1/2003 | Schantz |
| 6,529,166 | B2 | 3/2003 | Kanamaluru |
| 6,590,545 | B2 * | 7/2003 | McCorkle ..... 343/830 |
| 6,593,886 | B2 | 7/2003 | Schantz |
| 6,621,462 | B2 | 9/2003 | Barnes |

(Continued)

FOREIGN PATENT DOCUMENTS

| | | |
|---|---|---|
| CN | 1367552 | 9/2002 |

(Continued)

OTHER PUBLICATIONS

'Antennas' by John D. Kraus and Ronald J. Marhefka, McGraw Hill 2002 3/e, p. 782.

(Continued)

*Primary Examiner*—Shih-Chao Chen
(74) *Attorney, Agent, or Firm*—Sterne, Kessler, Goldstein & Fox, P.L.L.C.

(57) ABSTRACT

Antennas for transmitting and receiving ultrawideband (UWB) signals are disclosed. A UWB antenna structure includes a planar conductor of substantially uniform resistance. The structure has the shape of a pair of conjoined, generally triangular figures, each with a long side, a short side, and a curved side. The triangular figures have an antenna feed connection at one corner. The structure has an axis of symmetry passing through the antenna feed connection.

20 Claims, 36 Drawing Sheets

U.S. PATENT DOCUMENTS

| | | | | |
|---|---|---|---|---|
| 6,642,903 | B2 | 11/2003 | Schantz | |
| 6,667,724 | B2 | 12/2003 | Barnes et al. | |
| 6,693,600 | B1 * | 2/2004 | Elliot | 343/773 |
| 2002/0053994 | A1 | 5/2002 | McCorkle | |
| 2002/0122010 | A1 | 9/2002 | McCorkle | |
| 2002/0126051 | A1 | 9/2002 | Jha | |
| 2002/0154064 | A1 | 10/2002 | Barnes | |
| 2003/0011525 | A1 | 1/2003 | Sanad | |
| 2003/0090436 | A1 | 5/2003 | Schantz et al. | |
| 2004/0021613 | A1 | 2/2004 | Nesic et al. | |

FOREIGN PATENT DOCUMENTS

| | | |
|---|---|---|
| EP | 0500380 | 8/1992 |
| EP | 0618641 | 3/1994 |
| EP | 1324423 | 12/2001 |
| EP | 1193796 | 4/2002 |
| WO | WO 98/04016 | 1/1998 |
| WO | WO 99/13531 | 3/1999 |
| WO | WO 01/84670 | 11/2001 |
| WO | WO 01/91232 | 11/2001 |
| WO | WO 02/13313 | 2/2002 |
| WO | WO 02/27864 | 4/2002 |
| WO | WO 02/089253 | 11/2002 |
| WO | WO 03/044968 | 5/2003 |

OTHER PUBLICATIONS

'SMT-3TO10M Antenna' Sold by Skycross Corp., Florida USA.

J. Peeters Weem, B.M. Notaros, Z. Popovic, "Broadband Element Array Considerations for SKA", Proc. Persp. on Radio Astronomy: Technologies for Large Antenna Arrays, Dwingeloo, Apr. 1999, ISBN: 90-805434-2-X.

Abstract of CN1367552; Classification H01Q13/02; Platnum Information Comm Co Lt (KR).

"An Introduction to UWB Antennas", H. Schantz 2003 IEEE UWBST Conference.

"A Brief History of UWB Antennas", H. Schantz 2003 IEEE UWBST Conference.

"Bottom Fed Planar Elliptical UWB Antennas" H. Schantz, 2003 IEEE UWBST Conference.

"Frequency Notched UWB Antennas" H. Schantz, 2003 IEEE UWBST Conference.

"UWB Magnetic Antennas" H. Schantz, 2003 IEEE UWBST Conference.

"Planar Elliptical Element UWB Dipole Antennas" H. Schantz, 2002 IEEE APS/URSI Symposium.

"Radiation Efficiency of UWB Antennas" H. Schantz, 2003 IEEE UWBST Conference.

"Electromagnetic Energy Around Hertzian Dipoles" H. Schantz, IEEE Antenna & Prop. Magazine vol. 43, Apr. 2001.

PCT International Search Report Dated Aug. 3, 2004. (3 pages).

J. Thaysen, K.B. Jakobsen, J. Appel-Hansen, "A Wideband Balun—How Does It Work?", *More Practical Filters and Couplers: A Collection from Applied Microwave & Wireless, Noble Publishing Corporation*, ISBN 1-884932-31-2, 2002, pp. 77-82.

M. Basraoui, P. Shastry, "Wideband Planar Log-Periodic Balun", International Journal of RF and Microwave Computer-Aided Engineering, vol. 11, Issue 6, Nov. 2001, pp. 343-353.

Filipovic et al., "A Planar Broadband Balanced Doubler Using a Novel Balun Design", IEEE Microwave and Guided Wave Letters, vol. 4, No. 7, Jul. 1994.

'SMT-3TO10M Antenna' Sold by Skycross Corp. , Florida USA, Dec. 10, 2003.

Abstract of CN1367552; Classification H01Q13/02; Platnum Information Comm Co Lt (KR), Sep. 4, 2002.

* cited by examiner

3100

3100

ULTRAWIDEBAND ANTENNA

This application is a continuation-in-part of PCT/GB2003/05070 and hereby claims the benefit of the filing date of Nov. 21, 2003 and is incorporated by reference herein.

BACKGROUND OF THE INVENTION

This invention generally relates to wideband antennas, and in particular to antennas for transmitting and receiving ultrawideband (UWB) signals.

Techniques for UWB communication developed from radar and other military applications, and pioneering work was carried out by Dr G. F. Ross, as described in U.S. Pat. No. 3,728,632. Ultra-wideband communications systems employ very short pulses of electromagnetic radiation (impulses) with short rise and fall times, resulting in a spectrum with a very wide bandwidth. Some systems employ direct excitation of an antenna with such a pulse which then radiates with its characteristic impulse or step response (depending upon the excitation). Such systems are referred to as carrierless or "carrier free" since the resulting rf emission lacks any well-defined carrier frequency. However other UWB systems radiate one or a few cycles of a high frequency carrier and thus it is possible to define a meaningful centre frequency and/or phase despite the large signal bandwidth. The US Federal Communications Commission (FCC) defines UWB as a −10 dB bandwidth of at least 25% of a centre (or average) frequency or a bandwidth of at least 1.5 GHz; the US DARPA definition is similar but refers to a −20 dB bandwidth. Such formal definitions are useful and clearly differentiates UWB systems from conventional narrow and wideband systems but the techniques described in this specification are not limited to systems falling within this precise definition and may be employed with similar systems employing very short pulses of electromagnetic radiation.

UWB communications systems have a number of advantages over conventional systems. Broadly speaking, the very large bandwidth facilitates very high data rate communications and since pulses of radiation are employed the average transmit power (and also power consumption) may be kept low even though the power in each pulse may be relatively large. Also, since the power in each pulse is spread over a large bandwidth the power per unit frequency may be very low indeed, allowing UWB systems to coexist with other spectrum users and, in military applications, providing a low probability of intercept. The short pulses also make UWB communications systems relatively unsusceptible to multipath effects since multiple reflections can in general be resolved. The use of short pulses also facilitates high resolution position determination and measurement in both radar and communication systems. Finally UWB systems lend themselves to a substantially all-digital implementation, with consequent cost savings and other advantages.

FIG. 1*a* shows an example of a UWB transceiver 100 comprising a transmit/receive antenna 102 coupled, via a transmit/receive switch 104, to a UWB receiver 106 and UWB transmitter 108. In alternative arrangements separate transmit and receive antennas may be provided.

The UWB transmitter 108 may comprise an impulse generator modulated by a base band transmit data input and, optionally, an antenna driver (depending upon the desired output power). One of a number of modulation techniques may be employed, for example on-off keying (transmitting or not transmitting a pulse), pulse amplitude modulation, or pulse position modulation. A typical transmitted pulse is shown in FIG. 1*b* and has a duration of less than 1 ns and a bandwidth of the order of gigahertz.

FIG. 1*c* shows an example of a carrier-based UWB transmitter 120. This form of transmitter allows the UWB transmission centre frequency and bandwidth to be controlled and, because it is carrier-based, allows the use of frequency and phase as well as amplitude and position modulation. Thus, for example, QAM (quadrature amplitude modulation) or M-ary PSK (phase shift keying) may be employed.

Referring to FIG. 1*c*, an oscillator 124 generates a high frequency carrier which is gated by a mixer 126 which, in effect, acts as a high speed switch. A second input to the mixer is provided by an impulse generator 128, filtered by an (optional) bandpass filter 130. The amplitude of the filtered impulse determines the time for which the mixer diodes are forward biased and hence the effective pulse width and bandwidth of the UWB signal at the output of the mixer. The bandwidth of the UWB signal is similarly also determined by the bandwidth of filter 130. The centre frequency and instantaneous phase of the UWB signal is determined by oscillator 124, and may be modulated by a data input 132. An example of a transmitter with a centre frequency of 1.5 GHz and a bandwidth of 400 MHz is described in U.S. Pat. No. 6,026,125. Pulse to pulse coherency can be achieved by phase locking the impulse generator to the oscillator.

The output of mixer 126 is processed by a bandpass filter 134 to reject out-of-band frequencies and undesirable mixer products, optionally attenuated by a digitally controlled rf attenuator 136 to allow additional amplitude modulation, and then passed to a wideband power amplifier 138 such as a MMIC (monolithic microwave integrated circuit), and transmit antenna 140. The power amplifier may be gated on and off in synchrony with the impulses from generator 128, as described in U.S. Pat. No. '125, to reduce power consumption.

FIG. 1*d* shows a block diagram of a UWB receiver 150. An incoming UWB signal is received by an antenna 102 and provided to an analog front end block 154 which comprises a low noise amplifier (LNA) and filter 156 and an analog-to-digital converter 158. A set of counters or registers 160 is also provided to capture and record statistics relating to the received UWB input signal. The analog front end 154 is primarily responsible for converting the received UWB signal into digital form.

The digitised UWB signal output from front end 154 is provided to a demodulation block 162 comprising a correlator bank 164 and a detector 166. The digitised input signal is correlated with a reference signal from a reference signal memory 168 which discriminates against noise and the output of the correlator is then fed to the detector which determines the n (where n is a positive integer) most probable locations and phase values for a received pulse.

The output of the demodulation block 162 is provided to a conventional forward error correction (FEC) block 170. In one implementation of the receiver FEC block 170 comprises a trellis or Viterbi state decoder 172 followed by a (de) interleaver 174, a Reed Solomon decoder 176 and (de) scrambler 178. In other implementations other codings/decoding schemes such as turbo coding may be employed.

The output of FEC block is then passed to a data synchronisation unit 180 comprising a cyclic redundancy check (CRC) block 182 and de-framer 184. The data synchronisation unit 180 locks onto and tracks framing within the received data separating MAC (Media Access Control)

control information from the application data stream(s) providing a data output to a subsequent MAC block (not shown).

A control processor 186 comprising a CPU (Central Processing Unit) with program code and data storage memory is used to control the receiver. The primary task of the control processor 186 is to maintain the reference signal that is fed to the correlator to track changes in the received signal due to environmental changes (such as the initial determination of the reference waveform, control over gain in the LNA block 156, and on-going adjustments in the reference waveform to compensate for external changes in the environment).

There are demanding requirements on antennas suitable for UWB communications and other UWB applications such as UWB radar. The most obvious requirement is for an antenna with a very wide bandwidth. Conventionally an antenna is considered broadband if the ratio of maximum to minimum frequency of operation of the antenna is only 1.2:1, where the maximum and minimum operating frequencies are defined by, for example, the 3 dB received signal power points (at which the received signal power falls to half its centre or maximum in-band value). Ultrawideband systems, however, generally require ratios of 2:1 or 3:1. However for many applications a broadband frequency response is not enough and a good phase response across the band is also required. This can be seen by considering the effects of dispersion in the time domain in the above described receiver. In order to properly capture a received UWB signal components of a pulse should have a maximum displacement in time from one another which is much less than the period of the highest frequency component of the signal present at a significant level. For example where a UWB signal has an upper roll-off frequency of, say, 10 GHz, corresponding to a period of 100 ps the time (or phase) dispersion should preferably be significantly less than 100 ps. As the skilled person will appreciate low phase dispersion translates to low frequency dispersion.

One conventional broadband antenna is the log periodic array, which comprises a string of dipole antennas fed alternately by a common transmission line. The dipole antennas are of different lengths in order to provide a set of overlapping frequency responses. However because the dipole elements are spaced apart on the antenna, different frequency components reach the antenna at different times and thus the effective position of the antenna moves with frequency, giving rise to time/phase dispersion.

Another wideband antenna is the biconical antenna, the shape of which is substantially frequency independent. An example of an ultrawideband biconical antenna is described in U.S. Pat. No. 5,923,299. Biconical antennas can, however, have difficulties providing a sufficiently flat, wideband response and the biconical shape is relatively bulky, complex and expensive to manufacture.

Tapered slot or Vivaldi antennas have a theoretically infinite bandwidth but in practice there are difficulties providing a suitable feed to such an antenna. The antennas can also be relatively costly to manufacture. An example of a UWB antipodal tapered slot antenna is described in WO02/089253.

A cross-polarised UWB antenna system comprising a magnetic dipole slot antenna and an ultrawideband dipole antenna is described in, inter alia, WO99/13531, U.S. Pat. No. 6,621,462, and US2002/0154064. Again, however, this is a relatively complex configuration and the dipole shape appears to be based upon the principle of spreading the resonance of the antenna by, in effect, reducing the Q, but nonetheless the design would appear to exhibit significant potential for undesired resonances.

An elliptical planar dipole UWB antenna is described in US 2003/0090436 but the elliptical shape is non-optimal and the antenna apparently works by establishing current flows around the periphery of the antenna.

One commercially available broadband antenna which can be utilised for UWB communications is the SMT-3TO10M from SkyCross Corp., Florida USA, which comprises a form of folded dipole.

Other background prior art can be found in U.S. Pat. No. 5,973,653, EP1 324 423A, US 2003/011525, US 2002/126051, USH1773H, WO98/04016, U.S. Pat. No. 5,351,063, EP0 618 641 A, and in 'Antennas' by John D Kraus and Ronald J Marhefka, McGraw Hill 2002 3/e (for example at page 782, which describes a resistance-loaded bow-tie antenna for ground penetrating radar). Helical antennas are sometimes employed to provide circular polarisation. Circular patch antennas are known but these are relatively narrowband devices (their bandwidth does not approach that desirable in a UWB system) comprising a circular area of copper parallel to a ground plane.

SUMMARY OF THE INVENTION

There is therefore a need for improved electromagnetic antenna structures, in particular for ultrawideband use.

According to a first aspect of the present invention there is therefore provided an antenna, the antenna comprising an antenna body having an antenna feed coupling region for coupling an antenna feed to the antenna; wherein said antenna body effectively comprises a plurality of substantially straight conducting elements, said conducting elements having lengths ranging from a first length to a second, shorter length, a said length defining a resonant frequency of a said element; wherein each of said conducting elements has a proximal end in said coupling region, a said element having either said first length or said second length defining an antenna axis, said elements being disposed at angles to said antenna axis; and wherein the length of an element at an angle to said antenna axis is determined by a linear relationship between the angle and the resonant frequency for the length.

In embodiments, because each of the conducting elements has a proximal end in the coupling region, in effect providing a common feed point, the antennas are effectively co-sited thus giving reduced phase dispersion. Preferably, therefore, the antenna feed coupling region comprises an antenna feed point. The first length corresponds to a minimum frequency for the antenna and the second length to a maximum frequency for the antenna (discounting higher order standing waves and other lower frequency resonances which may be present). Although resonance is not a fundamental requirement of an antenna resonant elements facilitate (broadband) matching to the antenna and provide increased gain through more efficient radiation.

In embodiments providing a linear relationship between element angle and the resonant frequency for the element facilitates a theoretically flat response, for example by providing a substantially constant number of elements per unit frequency. Preferably the length of an element at an angle to the antenna axis is determined by the resonant frequency of the element, a difference between a resonant frequency of an element at an angle and the minimum resonant frequency being (linearly) determined by a difference between the maximum and minimum frequencies multiplied by the angle expressed as a function of a maximum angle at which an element is disposed to the antenna axis.

In preferred embodiments the antenna body has an axis of symmetry passing through the coupling region such that effective conducting elements on one side of the axis of symmetry have counterparts on the opposite side of the axis of symmetry. Without this configuration the angular response, in particular the direction of the maxima, and polarisation would rotate depending upon the frequency of a received signal component. It is therefore strongly preferable that elements to either side of the axis of symmetry are paired so that current vectors along the element sum to give a resultant along the axis of symmetry. Were elements having the second length (corresponding to a maximum resonant frequency) to be at 90 degrees to the axis of symmetry there would be substantially no resultant along the axis of symmetry and it is therefore preferable that the maximum angle elements make with the axis of symmetry is less than 90 degrees, more preferably less than 60 degrees, most preferably substantially equal to or less than 45 degrees. Preferably the antenna axis substantially coincides with the axis of symmetry (although in some embodiments the antenna may have a notch at the top).

The general appearance of the antenna is that of two symmetric triangles conjoined along the antenna axis. The antenna axis preferably defines an element having the first (longer) length, in which case the antenna has the general appearance of a spearhead. Preferably the element defining the aforementioned maximum frequency of the antenna defines a substantially straight side, or (in symmetric embodiments) a pair of sides, of the antenna body.

In preferred embodiments the antenna body comprises a substantially continuous conductor and the conducting elements comprise conducting pathways within this conductor (albeit close to the surface at high frequencies). Distal ends of the elements then define a boundary of the conductor and, in effect, the aforementioned lengths of the elements define a shape for the edge of the conductor. Such a substantially continuous conductor, in preferred embodiments also has a substantially uniform conductance, can be considered as comprising a substantially infinite number of infinitesimal resonant elements or dipoles. The shape of the boundary of the conductor may then be defined by the condition that an equal number of these infinitesimal elements is provided per unit bandwidth of the antenna, that is for each of a plurality of equal frequency divisions of the antenna bandwidth. In other embodiments, however, a flat response may be approximated by a plurality of separate conducting elements radiating from the feed point, the larger the number of elements the better the approximation to a desired flat response. Thus for such embodiments the antenna preferably comprises more than 3, 5, 10 or 100 elements, in practice approaching a substantially continuous conductor as the number of elements increases.

In a preferred embodiment the length of an element is substantially equal to a quarter wavelength at the resonant frequency of the element, although other lengths such as half or three quarter wavelengths are possible. For example it is possible to shorten the physical length of a narrowband resonant antenna element by employing a coil at the base (feed point) of the element.

In a particularly preferred embodiment the antenna body is substantially planar, as this facilitates manufacture by, for example, a straightforward PCB (printed circuit board) or substrate etch process. Thus the antenna preferably comprises an etched copper or other metal layer supported by a dielectric substrate. In other embodiments, however, the antenna body may be self-supporting and formed from a shaped metal plate.

The antenna may be used in either a monopole or a dipole configuration. In a monopole configuration the antenna body is preferably provided with a ground plane, for example a conducting or partially conducting surface, substantially perpendicular to the body of the antenna. In a dipole configuration a pair of antennas each as previously described is preferably substantially symmetrically disposed about a centre line between the antennas. The two arms of the dipole may lie in substantially the same plane, facilitating fabrication on a circuit board of substrate, or they may be crossed, for example at 90° to one another.

In such a dipole configuration the gap between the antennas is preferably as small as possible, or at least is preferably less than a wavelength at a maximum design resonant frequency of the antenna. This is because the separation between the antenna bodies affects the input impedance of the antenna and it is preferable to aim for a substantially constant input impedance across the bandwidth of the antenna. Thus, for example, in embodiments the separation between the two antenna bodies is preferably less than 2 mm, more preferably less than 1 mm (for an antenna with a maximum design frequency of up to, say, 10 GHz).

Where, as in some preferred embodiments, the antennas are formed from a metal layer on a substrate it is preferable to employ a balanced line feed to the antenna to avoid the need for a ground plane in the vicinity of the antenna which could interfere with the antenna's operation. In such a configuration the minimum separation of the antennas may depend upon the dimensions of the balanced line over the design frequency range, for example at the minimum design frequency, and in such a case it is therefore preferable to provide a separation between the antenna bodies which is not substantially more than is needed to provide the antenna with a balanced line feed.

When a dipole is fabricated on a substrate the arms of the dipole may lie on opposite sides of the substrate (or at least lie in planes separated by one or more substrate layers) as this facilitates providing a balanced feed to the dipole.

In preferred embodiments the antenna is an ultrawideband antenna. For example the ratio of maximum to minimum design frequencies (for example as measured at 3 dB or half power points) may be greater than 1.5:1, 2:1, 2.5:1, 3:1, or greater.

In embodiments the conducting elements define one or more apertures or notches in the antenna body to provide a notch in the frequency response of the antenna. First and second edges of an aperture or notch may be defined by respective first and second conducting elements the second element (say) having a shorter length than the first element, the resonant frequencies of these two elements then defining the respective lower and upper frequencies of the notch in the frequency response. In other words the length of the conducting elements defining the edges of the notch or aperture also define frequencies between which a corresponding notch in the frequency response is situated. Where, as is preferable, the antenna body is symmetrical, the notches or apertures are also preferably symmetrically disposed about the axis of symmetry.

In another aspect the invention provides an ultrawideband antenna structure comprising a planar conductor of substantially uniform resistance, the structure having the shape of a pair of conjoined, generally triangular figures each with a long side, a short side and a curved side, with an antenna feed connection at one corner, the structure having an axis of symmetry passing through said antenna feed connection.

The generally triangular figures are preferably joined along their long sides. It will be appreciated that "conjoined triangles" describes the shape of the structure but generally not its method of construction (it will generally be fabricated as one piece).

Preferably the structure has a first pair of substantially straight sides diverging from the antenna feed connection (which need not be a sharp corner) and a second pair of curved sides which converge towards a point opposite the antenna feed connection, the axis of symmetry then defining two halves of the structure each with one straight and one curved side. Preferably a curved side is defined by a curve comprising a portion of a locus of points for which the inverse of the distance of a point from the antenna feed connection is substantially proportional to the angle between a line joining the point to the antenna feed connection, and the axis of symmetry. As previously mentioned the substantially straight sides are preferably at an angle of less than 60 degrees to the axis of symmetry, more preferably at an angle of equal to or less than 45 degrees to this axis.

In embodiments the antenna structure includes one or more radially extending edges defining one or more notches in the structure (the radial direction being defined with reference to the antenna feed connection and extending away from this point). The notches preferably intersect the curved edges of the structure, and are preferably symmetrically disposed about the axis of symmetry. Preferably the notches extend back substantially to the antenna feed connection.

In a preferred embodiment a pair of the antenna structures are symmetrically disposed on a circuit board or substrate and provided with a balanced feed. Preferably the structures are then located as close to one another as the balanced feed allows.

In a further related aspect the invention provides an antenna structure comprising a substantially uniform resistance planar conductor with an antenna feed, the structure having the shape of a pair of conjoined, generally triangular figures each with a long side, a short side and a curved side, the structure having an axis of symmetry passing through said antenna feed, and wherein said structure has a first pair of substantially straight sides diverging from said antenna feed, and a second pair of curved sides which converge towards a print opposite said antenna feed.

The invention further provides an ultrawideband antenna, the antenna comprising an antenna body having an antenna feed, and wherein said antenna body has substantially circular cross-section.

Preferably the antenna body is substantially circular to facilitate a practical construction. Such a circular antenna may be provided in either a monopole or a dipole configuration, the dipole configuration having a pair of antenna bodies either in substantially the same plane or twisted, for example through 90°, with respect to one another.

The invention further provides an ultrawideband antenna, the antenna comprising an antenna body having an antenna feed, said antenna body comprising a ground plane defining an aperture having a cross-section comprising a substantially circular non-conducting disc.

Preferably the antenna feed comprises a slotted line so that the aperture is shaped roughly like a table-tennis bat; this may then be driven by a line transversely across the "handle" of the bat.

The invention further provides an ultrawideband antenna structure comprising a planar conductor of substantially uniform resistance, the structure defining an aperture having the shape of a pair of conjoined generally triangular figures each with a long side, a short side and a curved side, with an antenna feed connection at one corner, the structure having an axis of symmetry passing through said antenna feed connection.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1A:
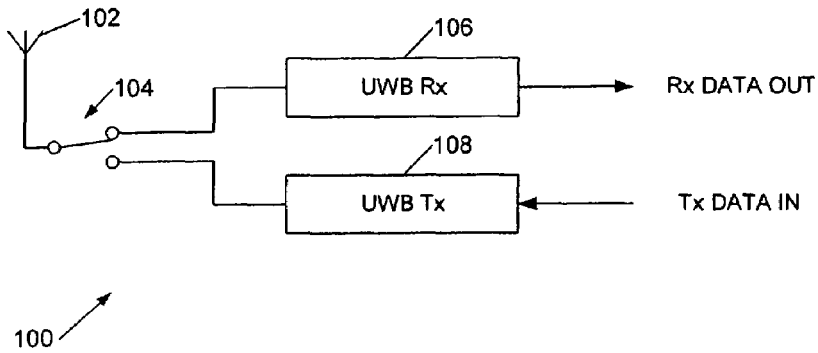
Figure 1a (PRIOR ART)
FIGS. 1*a* to 1*d* show, respectively, a UWB transceiver, a transmitted UWB signal, a carrier-based UWB transmitter, and a block diagram of a UWB receiver.
Figure 1B:
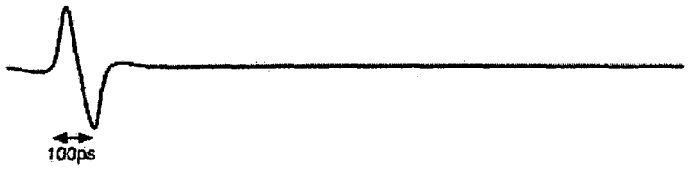
Figure 1b (PRIOR ART)
Figure 1C:
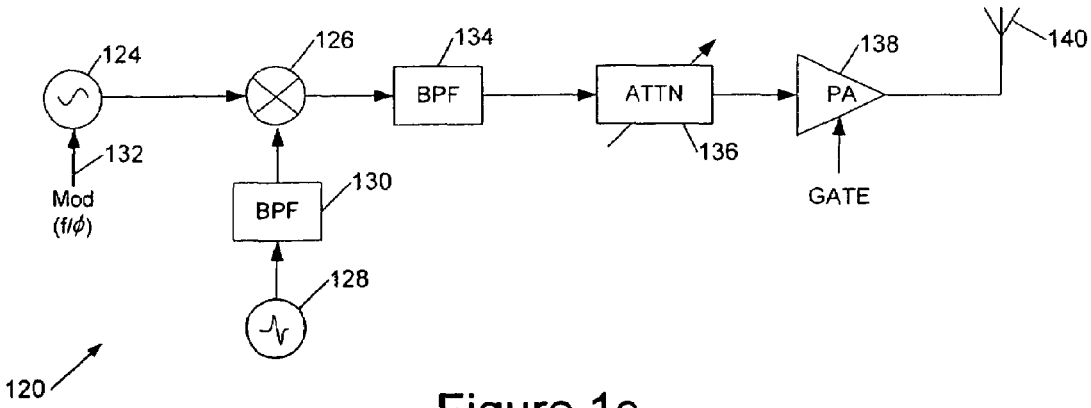
Figure 1c (PRIOR ART)
Figure 1D:
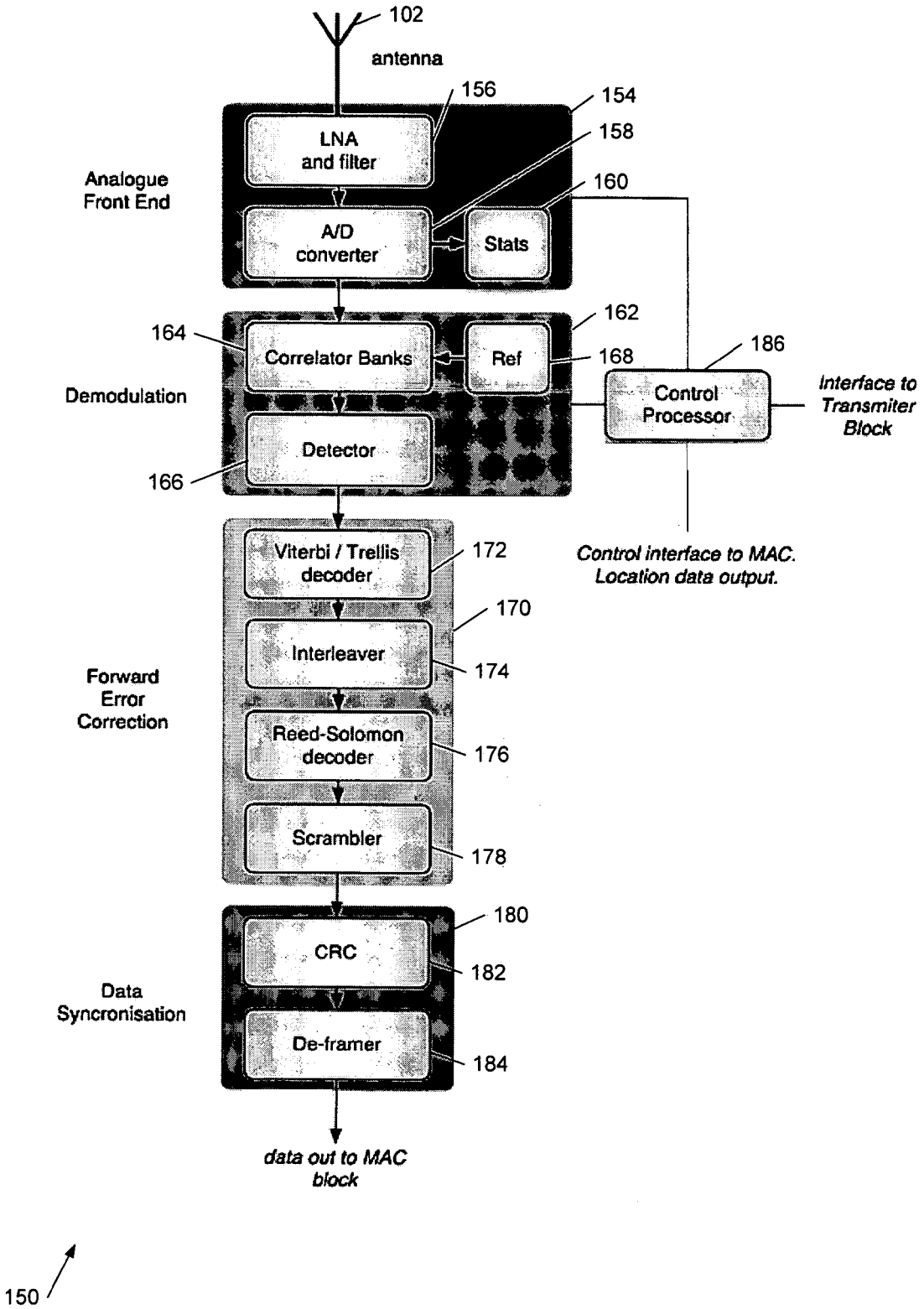
Figure 2A:
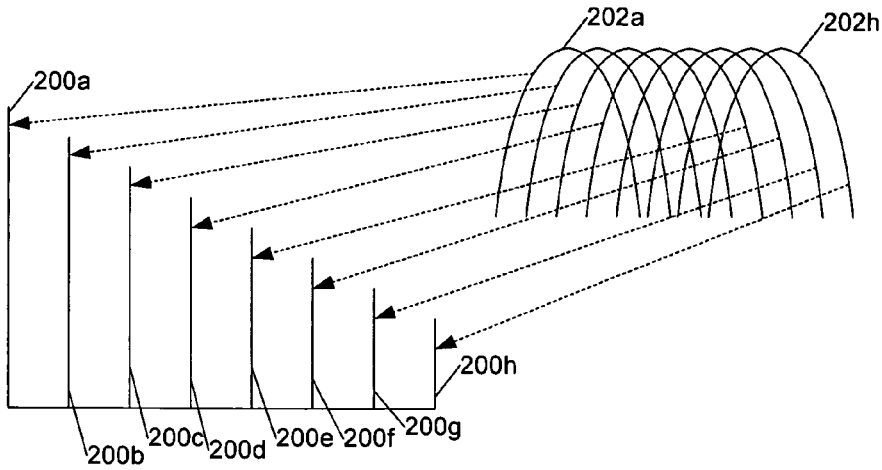
FIGS. 2*a* to 2*e* show, respectively, a plurality of quarter wave resonant elements and associated overlapping frequency responses, a plurality of co-sited quarter wave elements, a symmetrically configured plurality of co-sited quarter wave elements, vector summation of current elements, and a shaped conducting plate electrically modellable as a symmetrically configured plurality of co-sited quarter wave elements.
Figure 2B:
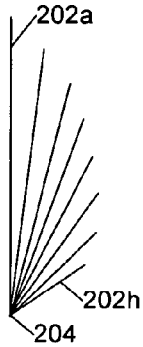

Referring now to FIG. 2*a*, this shows, diagrammatically, a set of quarter wave resonant elements 200*a*-200*h* together with their respective frequency responses 202*a*-202*h*. As can be seen the frequency responses overlap to, in theory, provide a substantially flat response over a wide bandwidth. FIG. 2*b* illustrates how these resonant elements may be combined in practice, using a common feed point 204. However, the arrangement of FIG. 2*b* has angular response and polarisation which is a function of frequency, and this is addressed by combining two sets of elements in a symmetric structure 210 as shown in FIG. 2*c*.

The way in which the structure of FIG. 2*c* works can be explained with reference to FIG. 2*d*, which shows a pair of current of equal magnitude which sum to give a resultant vector along line 214 bisecting the angle between vectors 212*a* and 212*b*. In the structure of FIG. 2*c* each element apart from the central element 202 is paired, elements of a pair lying at equal angles to either side of a central axis defined by element 202*a*, as shown, for example, by elements 202*h*, 202*h*'. The result of this is that each pair of dipole elements in effect acts as a single vertical element of the same resonant length. This provides an antenna which behaves substantially as if it comprised a set of elements of different resonant lengths on top of one another lying along an axis of symmetry (antenna axis) defined by central element 202*a*. In other words the structure shows how, in effect, the elements 202*a*-*h* of FIG. 2*a* may be practically superimposed upon one another. Effectively co-siting the elements in this way reduces the time/phase dispersion of the antenna. Because the antennas are co-sited the different frequency components of a received signal reach receiving elements for the frequency components at similar times (and are transmitted at similar times in a transmitter antenna), thus resulting in a low time dispersion for the antenna which is useful for UWB communications and radar.

The antenna structure has been described in terms of a plurality of separate resonant elements but in a preferred practical embodiment these elements are merely conceptual conducting pathways within a substantially continuous conducting plate or layer, for example of copper or some other metal. This is illustrated in FIG. 2*e* which shows an antenna structure 220 which can be modelled as an infinite number of infinitessable resonant elements 222. The foregoing description is a useful aid in understanding the operation of an antenna structure of this type but, in practice, there is no need to provide separate elements as previously described.

The shape of the antenna structure 220 is important in optimising the flatness of the antenna frequency response. The aim is to provide an equal number of infinitessable quarter wave elements for each frequency within the bandwidth of the antenna.

Figure 2C:
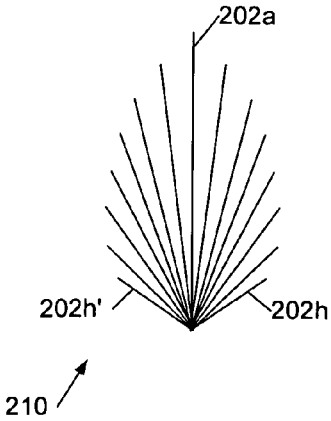
Figure 3A:
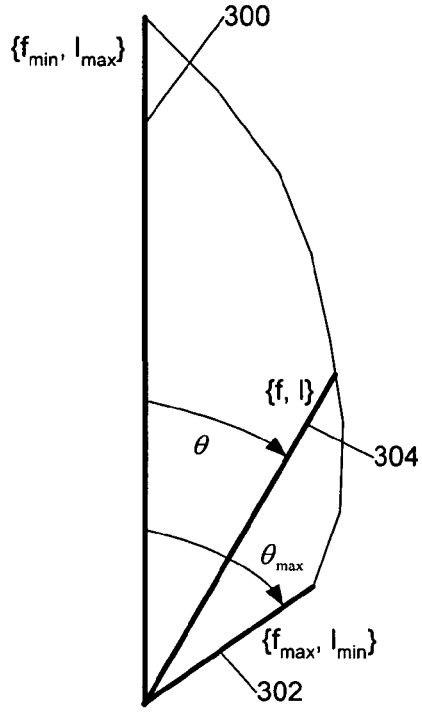
FIGS. 3*a* to 3*d* show, respectively, a schematic diagram illustrating determination of a shape for the conducting plate of FIG. 2*e*, a shaped antenna structure according to an embodiment of the present invention, an example of a measured frequency response of a monopole antenna having the configuration of FIG. 3*b*, and an alternative antenna structure.

FIG. 3*a* shows a diagram useful for understanding a preferred shape of the antenna structure. The structure is symmetric about an axis of symmetry 300 and therefore only one half of the structure is shown; the other half corresponds. Axis 300 corresponds to element 202*a* of FIG. 2*c* and line 302 corresponds to the shortest element in the structure, that is element 202*h* in FIG. 2*c*. The length, $l_{min}$ of the shortest element determines the maximum frequency $f_{max}$ roll off the antenna; the longest length in the structure, $l_{max}$ (long axis 300) determines the minimum resonant frequency $f_{min}$ of the antenna, at which the low frequency response rolls off. In the structure illustrated in FIG. 3*a* the maximum length lies along axis 300 and line 302 is at a maximum or "base" angle $\theta_{max}$ to this axis. A line 304 of length l, having a resonant frequency f is at an angle θ to angle 300.

It can be seen from FIG. 3*a* that the length of line 304 depends upon angle θ and the aim is to provide, in effect, a constant density of notional elements per unit bandwidth and, therefore, per unit angle. This leads to Equation 1 below, which links the resonant frequency f of an element along line 304 with angle θ as follows:

$$f=f_{min}+\theta/\theta_{max}(f_{max}-f_{min}) \qquad \text{Equation 1}$$

and for a quarter wave (wavelength λ) resonant element $$f=c/(4l) \qquad \text{Equation 2}$$

where c is the speed of the electromagnetic wave (approximately $3\times10^8$ m/s in air) and l is the length of the element (in metres) corresponding to frequency f.

Thus, example, for an antenna configured to operate between 3.6 GHz and 10.1 GHz, $l_{min}$ ($\lambda/4$, at ±45°) equals 7.4 mm and $l_{max}$ ($\lambda/4$, at 0°) equals 20.8 mm.

Figure 2D:
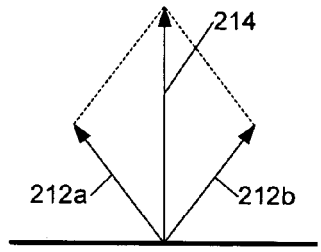
Figure 2E:
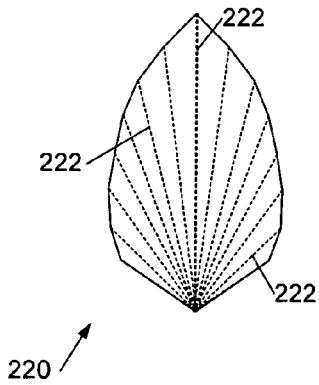

The angle $\theta_{max}$ is not critical but is preferably less than 90° since, by referring FIG. 2*d*, it can be seen that at an angle of 90° there is substantially no resultant vertical current vector component. The angle $\theta_{max}$ may be chosen to be, for example, 60° (so that the current vectors add up to unity) or 45° (current vectors add up to $\sqrt{2}$). As $\theta_{max}$ approaches 90° the shape of the antenna approaches that of an isosceles triangle with bulging sides.

In a practically constructed monopole embodiment with $\theta_{max}$=45° and using the above $l_{min}$ and $l_{max}$ values the input impedance was approximately 50 ohms and the reflection coefficient of the antenna was approximately 10% across the frequency band from 3.6 GHz to 10.1 GHz.

Figure 3B:
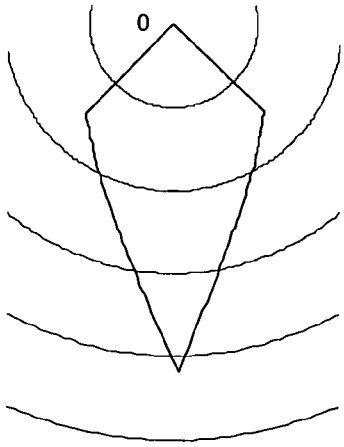
Figure 3C:
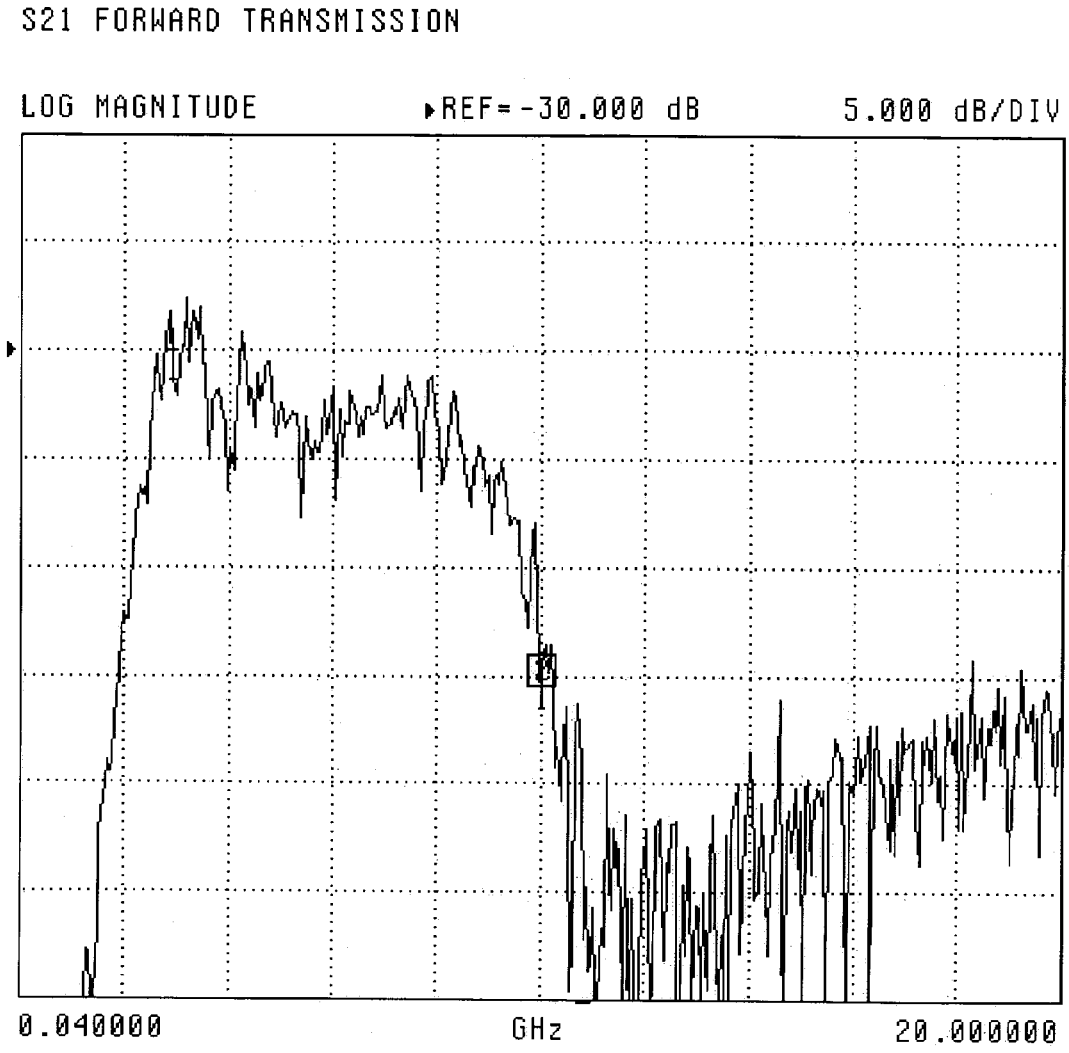

FIG. 3*b* shows a drawing of this practically constructed embodiment (the contours are at 5 mm intervals), and FIG. 3*c* shows an example of an actually measured frequency response for a monopole version of this antenna (as described further below), in particular S21, the forward transmission coefficient. As can be seen from FIG. 3*c* the useful frequency response of the antenna extends between approximately 3 GHz and 10 GHz.

Figure 3D:
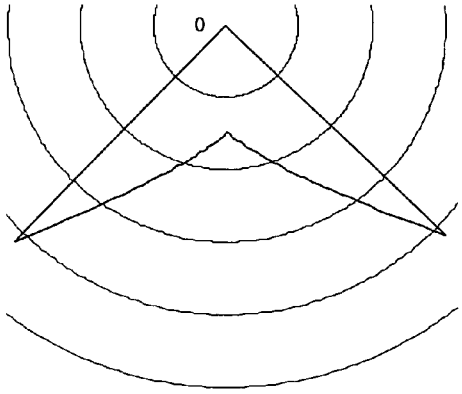

FIG. 3*d* shows an alternative, "inverted" version of the structure in which the shortest resonant length lies along axis 300 and the longest resonant length is at an angle $\theta_{max}$ to this axis, but this shape performs much less well than that of FIG. 3*b*. This may be because as $f_{max}$ increases the antenna shape approaches a pair of spikes, which would not be expected to have a wideband response.

Figure 4A:
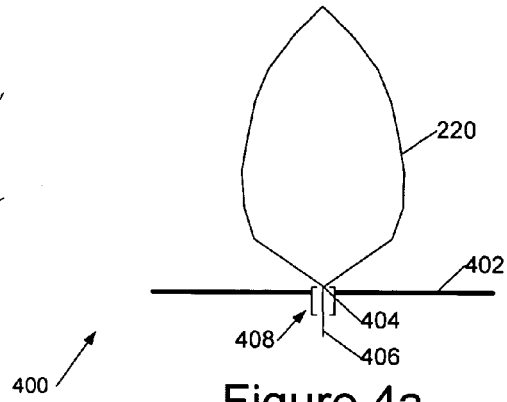
FIGS. 4*a* to 4*c* show, respectively, a monopole UWB antenna according to an embodiment of the present invention, and azimuthal and elevation plots of responses of the antenna of FIG. 4*a;*

FIG. 4*a* shows a monopole UWB antenna 400 utilising the structure 220 of FIG. 2*a*. The antenna 400 has a ground plane 402 which may be formed from any conducting or partially conducting surface including, for example, a portion of circuit board or a metal, for example copper, plate. The antenna structure 220 has a feed point 404 at its base and an antenna feed 406 passes through ground plane 404 to this point. The antenna feed 406 may comprise, for example, a conventional RF connector 408 to which structure 220 is attached.

Figure 4B:
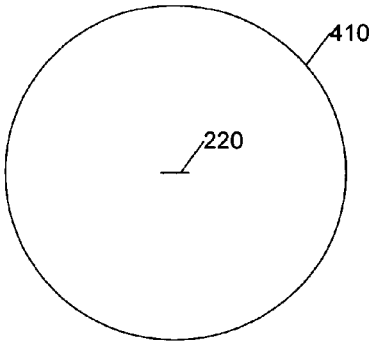

FIG. 4*b* shows an idealised, azimuthal plot of the response of antenna 400, viewed from above. As can been seen the antenna has a substantially isotropic azimuthal response 410 because of the way which the current vectors sum to lie along the antenna's axis of symmetry.

Figure 4C:
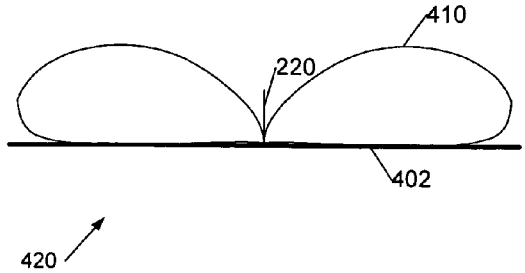

FIG. 4*c* shows the antenna of FIG. 4*a* viewed from the side, showing the response 410 of the antenna in elevation. As can be seen this corresponds to a conventional pattern expected for a quarter wave element above a ground plane. In practice some smaller lobes are encountered behind the ground plane (below ground plane 402 in FIG. 4*c*) which are not shown in FIG. 4*c*.

Figure 5A:
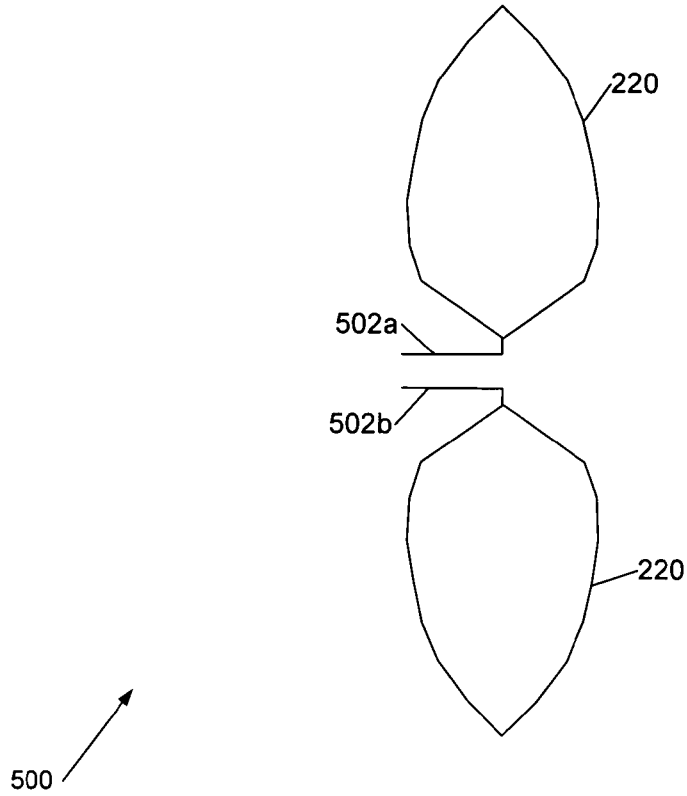
FIGS. 5*a* and 5*b* show, respectively, a dipole UWB antenna according to an embodiment of the present invention, and a plot of the response of the antenna of FIG. 5*a* in elevation.

FIG. 5*a* shows a dipole-type antenna 500 incorporating a symmetric pair of structures 220 each with a respective feed 502*a,b*. Dipole antenna 500 is preferably driven by a balanced signal which may derived, for example, from inverting a non-inverting output of antenna drivers coupled to a common UWB source.

Figure 5B:
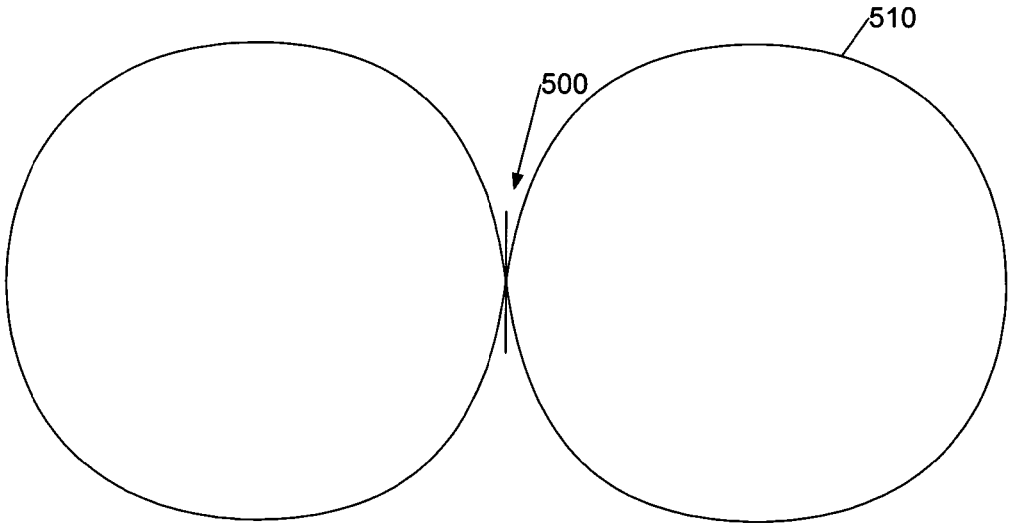

FIG. 5*b* shows an idealised response 510 of antenna 500 in elevation, that is when viewed from side. As can be seen the response is typical of a dipole; the azimuthal response (not shown) is substantially isotropic as described with reference to FIG. 4*b*.

Figure 6A:
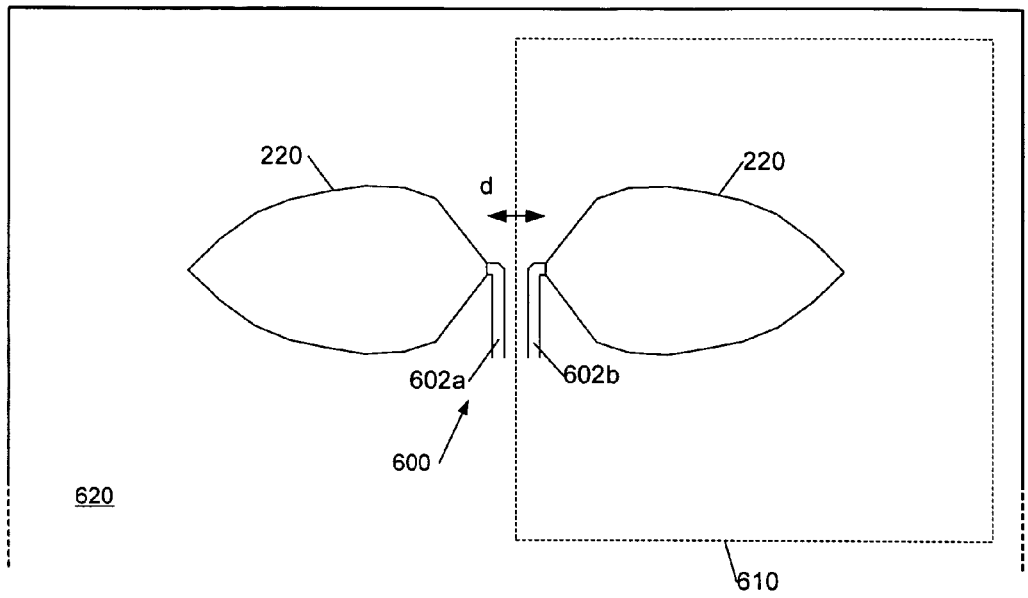
FIGS. 6*a* to 6*e* show, respectively, a dipole UWB antenna on a circuit board, and microstrip, stripline, coplanar wave guide, and balanced line feeds for the antenna of FIG. 6*a;*

FIG. 6*a* shows one preferred implementation of a dipole UWB antenna 600, fabricated upon a substrate 620, for example at an end of a PCMCIA (Personal Computer Memory Card International Association) card. Such an implementation has the advantage that, because the antenna structure is planar, the antenna may be fabricated by means of a conventional etch process. Any conventional substrate material may be employed, selected according to the frequency range over which the antenna is designed to operate. For example, FR408 may be used at frequencies of up to around 3 GHz and Rogers R04000 laminate up to 10 GHz. Other substrate materials which may be employed at high frequencies include RT/duroid, GML1000, IS620, and glass laminates. When designing the shape of the antenna structure it is preferable to take account of the dielectric constant of the substrate material (generally between 3.5 and 4.0) when determining the resonant element quarter wavelengths. Where the upper portion of the antenna structure 600 is effectively exposed to the air, the effective dielectric constant is modified and may be approximately half that of the substrate.

A monopole version of the UWB antenna may also be fabricated by replacing one half of the antenna 600 with a ground plane as schematically illustrated by dashed line 610.

In the dipole embodiment of the PCB (printed circuit board)—based antenna the spacing, d, between the two antenna structures 220 is important and should be as small as possible, and in particular smaller than a wavelength at the maximum design frequency of operation of the antenna (the upper frequency response knee). This is because the spacing d tunes the input impedance of the antenna and it is therefore preferable that the signal driving (or received by) the antenna should not see a value for d which changes substantially with frequency. In practice the minimum value of d will generally be determined by the type of antenna feed employed.

Figure 6B:
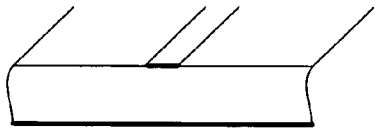
Figure 6C:
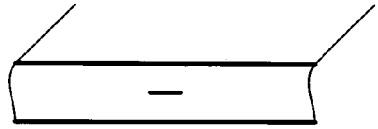
Figure 6D:
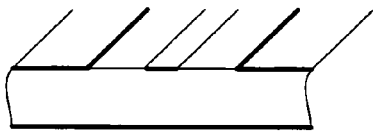
Figure 6E:
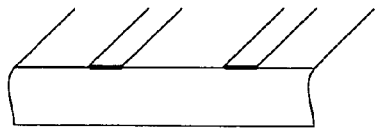

Each of the antenna structures 220 has a respective antenna feed 602*a, b* to allow the antenna to be driven by a balanced or differential signal. FIGS. 6*b* to 6*e* show antenna feed structures which may be employed, FIG. 6*b* showing a microstrip feed, FIG. 6*c* a stripline feed, FIG. 6*d* a co-planar wave guide feed, and FIG. 6*e* a balanced line feed. In FIGS. 6*b* to 6*e* metal layers are shown by lines of increased thickness and it can be seen that all the structures except for the balanced line feed have one or more associated ground planes. Because such a ground plane can interfere with the operation of the antenna it is preferable to employ a balanced line-type feed structure as shown in FIG. 6*e*. For the 3-10 GHz antenna structure described above a 50 ohm feed may be provided by means of two 8 thou (0.2 mm) lines 15 thou (0.38 mm) apart giving a total spacing, d, of approximately 30 thou (0.76 mm).

As the skilled person will understand, the dipole UWB antenna may be driven in any conventional manner. For example a pair of inverting and non-inverting amplifiers may be employed to provide a balanced feed or a balanced feed may be derived from an unbalanced or a symmetrically driven output by inserting a balun between the unbalanced feed and the antenna. Any conventional wideband balun structure may be employed as described, for example, in J. Thaysen, K. B. Jakobsen, and J. Appel-Hansen, "A wideband balun—how does it work?", More Practical Filters and Couplers: A Collection from Applied Microwave & Wireless, Noble Publishing Corporation, ISBN 1-884932-31-2, pp. 77-82,2002; M Basraoui and P Shastry, "Wideband Planar Log-Periodic Balun", International Journal of RF and Microwave Computer-Aided Engineering, Vol. 11, Issue 6, November 2001, pp. 343-353; and Filipovic et al. *"A Planar Broadband Balanced Doubler Using a Novel Balun Design"*; IEEE Microwave and Guided Wave Letters, Vol. 4 No. 7 July 1994; all hereby incorporated by reference.

One useful feature of the above described antenna structure 220 is that it can be appreciated from the explanation of the structure's operation how the structure may be modified in order to modify the frequency response.

It will be recalled from FIG. 2*e* that, conceptually, the antenna structure 220 comprises a plurality of infinitessimal resonant elements of different lengths, each length having a defined angle to the axis of symmetry of the structure. For some applications it is desirable to be able to provide a notch in the frequency response of a UWB antenna, for example in the 5 GHz band for a UWB system operating between 3 GHz and 10 GHz to reduce mutual interference with Hiperlan/2 and/or IEEE802.11a. Conceptually this may be achieved by omitting elements with lengths corresponding to frequencies at which it is desired to provide reduced response from the antenna structure 220. Inspection of FIG. 2*e* shows that to create a notch in the frequency response of the antenna structure between first and second frequencies elements of corresponding lengths between first and second angles may be omitted from the structure resulting in a tapered, radial notch in the structure.

Figure 7:
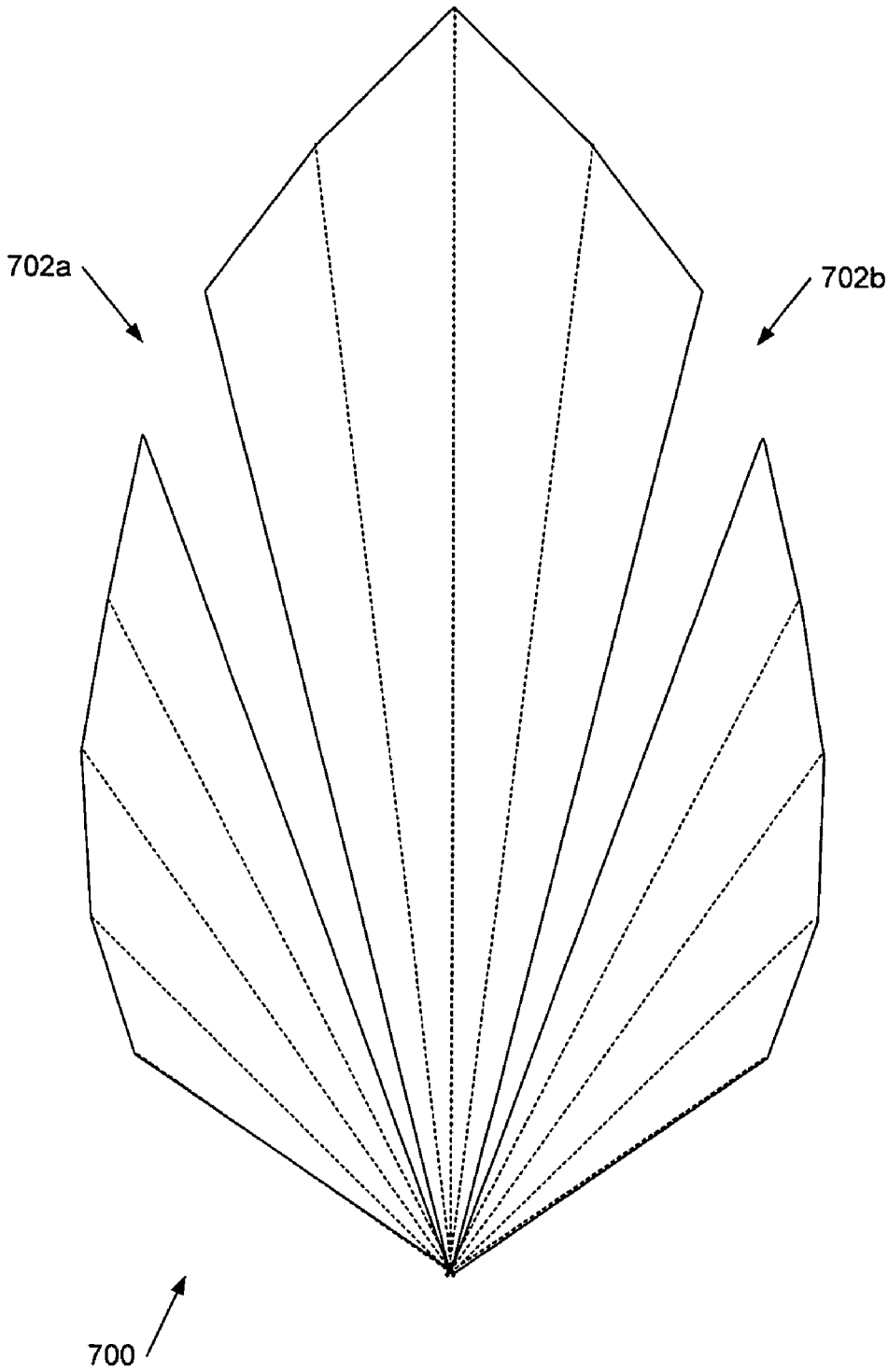
FIG. 7 shows an antenna structure including a symmetric pair of notches to provide a notched frequency response.

FIG. 7 shows an example of an antenna structure 700 configured to define a symmetrical pair of notches 702*a*, 702*b*. The upper and lower (longer and shorter) edges of these notches defines lengths corresponding to the lower and upper knees of the notch in the antenna response. The illustrated example shows an antenna configured to operate between 3 GHz and 10 GHz and the wedge-shaped radial notches provide a notch between, approximately 5 GHz and 6 GHz. The skilled person will understand from equations 1 and 2 above how the structure shown in FIG. 7 may be adapted to provide a notch between any desired pair of frequencies or a plurality of such notches.

We will now describe the results of some simulations run on variants of the above-described antenna structure (hereafter called a "Bishop's Hat" antenna). We will also describe a further novel ultrawideband antenna design comprising a circular antenna body. Both the Bishop's Hat and circular antennas may be slotted to reduce the responsiveness of the antenna over a narrowband of frequencies to attenuate interference such as interference from local 802.11 transmissions. Both the Bishop's Hat and circular antenna structures may be used in a monopole or a dipole configuration. Likewise both structures may be printed onto a PCB (printed circuit board) or substrate, the increased dielectric constant resulting in a physically smaller antenna suitable, for example, for PCMCIA applications.

A mathematical model was developed in accordance with equations 1 and 2 above, the MATHCAD™ script for which is given below.

The following MATHCAD™ script calculates the UWB antenna dimensions and exports data so that it may be used by electromagnetic simulation/analysis software.

Frequency range in GHz $f_{min} := 3.6$ $f_{max} := 10.1$

Define a range of angles: $\alpha_max_deg := 60$ $$\alpha_max := \alpha_max_deg \frac{\pi}{180}$$

$n_max := 63$ Must be odd $n := 0..n_max - 1$ $$\alpha_n := \alpha_max - 2n \cdot \frac{\alpha_max}{(n_max - 1)}$$

Define a frequency Range: $F_{max} := f_{min}$ $F_{min} := f_{max}$ $$f_n := \left| \begin{array}{l} m \leftarrow 2\dfrac{f_{min} - f_{max}}{n_max - 1} \\ mn + f_{max} \text{ if } n < \dfrac{n_max}{2} \\ -mn + (2f_{min} - f_{max}) \text{ if } n > \dfrac{n_max}{2} \end{array} \right. \qquad F_n := \left| \begin{array}{l} m \leftarrow 2\dfrac{F_{min} - F_{max}}{n_max - 1} \\ mn + F_{max} \text{ if } n < \dfrac{n_max}{2} \\ -mn + (2F_{min} - F_{max}) \text{ if } n > \dfrac{n_max}{2} \end{array} \right.$$

Calculate ideal lengths of dipoles (in mm): $c := 299792458 \frac{m}{s}$

Set mode, Mode 0, Standard Hat, Mode 1, Wing Shape; $Mode := 1$ $$\Delta_n := \left| \begin{array}{l} \dfrac{c}{4f_n \cdot GHz} \text{ if } Mode = 0 \\ \dfrac{c}{4F_n \cdot GHz} \text{ if } Mode = 1 \end{array} \right.$$

Rotate Antenna plot by: $\beta := \frac{\pi}{2}$ $\beta := 0$

Now we have to plot the vectors (dipole lengths (mm) at angle $\alpha$):

$$A_{n+1} := \Delta_n \cdot 1000 \cdot (\cos(\alpha_n) + i \cdot \sin(\alpha_n)) \cdot (\cos(\beta) + i \cdot \sin(\beta))$$

Add the origin points: $A_0 := 0$ $A_{n_max+1} := 0$

The parameters of the model include $F_{max}$, $F_{min}$ and the maximum single-sided angle subtended by the (monopole) elements, α_max. The model calculates a series of X-Y coordinates, formats and writes an output file to disk. If the maximum and minimum frequencies are swapped such that the shortest monopole (corresponding with $F_{max}$) is located centrally, then the wing shape is obtained; the mathematical model also calculates the X-Y coordinates of the 'wing' antenna.

Figure 8A:
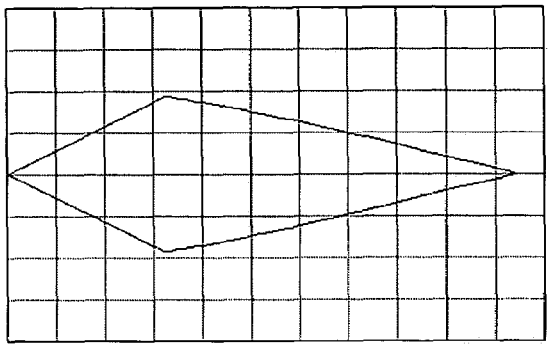
FIGS. 8*a* to 8*c* show, respectively 600, 90°, and 120° Bishop's Hat antenna structures.
Figure 8B:
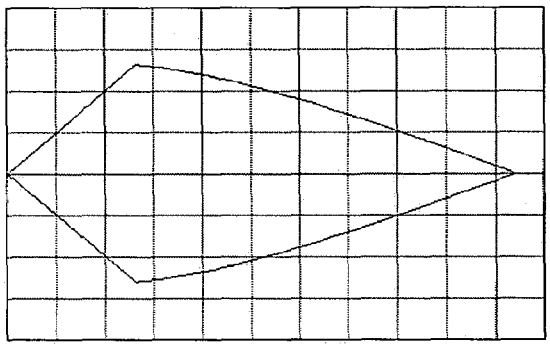
Figure 8C:
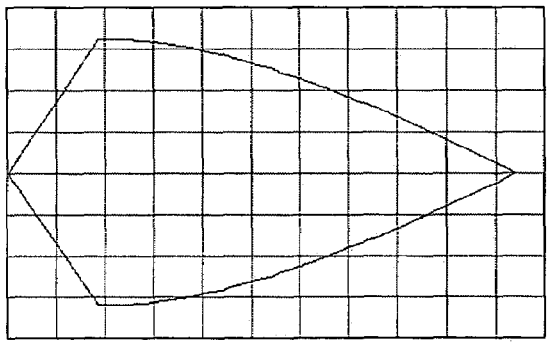

FIGS. 8*a* to 8*c* show graphically the output of the model with $F_{min}$ set to 3.6 GHz, $F_{max}$ to 10.1 GHz and the maximum subtended double-sided angle set to 60°, 90° and 120° respectively (only the Bishop's Hat variant is shown).

The above model can be used for an electromagnetic (EM) simulation of a structure using a standard software package such as Serenade™ from Ansoft Corporation, ADS from Agilent or Microwave Office from Applied Wave Research. The relevant design parameters are: the Lower Frequency Bound, the Upper Frequency Bound, and the Angle Subtended at centre (twice the above mentioned $\theta_{max}$).

Three different Bishop's Hat antenna were modelled, all over the same frequency range of 3.6 GHz to 10.1 GHz, but with different angles subtended at the centre, namely 60°, 90° and 120°.

Figure 9A:
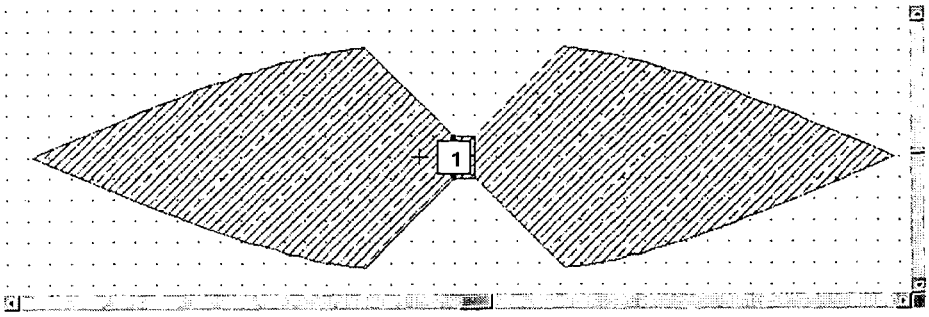
FIGS. 9*a* to 9*d* show, respectively, a dipole 90° Bishop's Hat antenna and an impedance chart (Zo=100 Ω), a return loss plot (Zo=100 Ω), and responses of principal planes of the antenna.
Figure 9B:
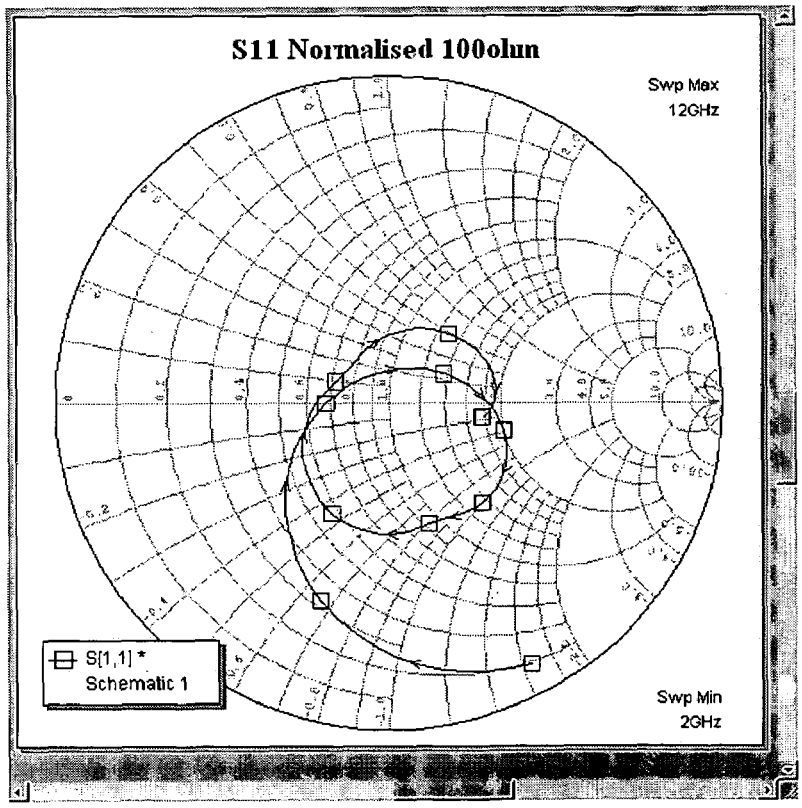
Figure 9C:
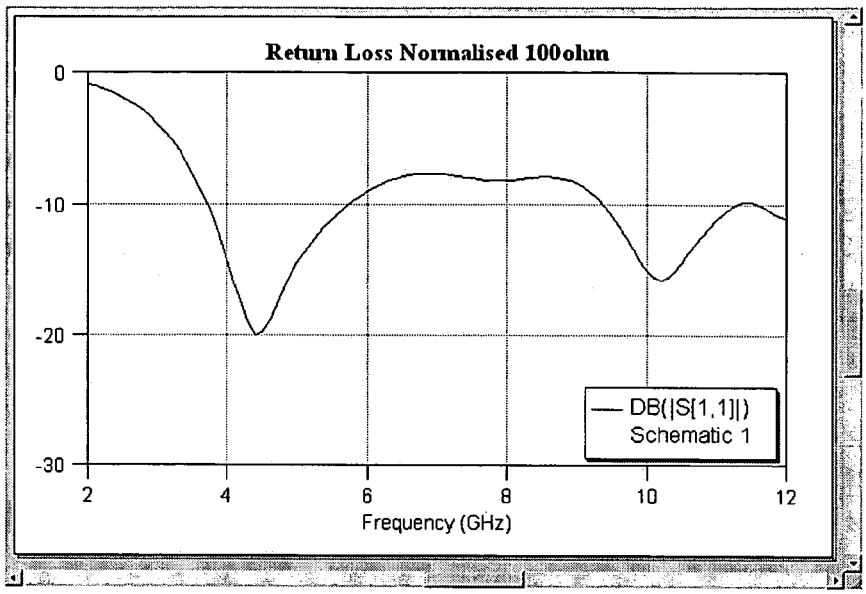
Figure 9D:
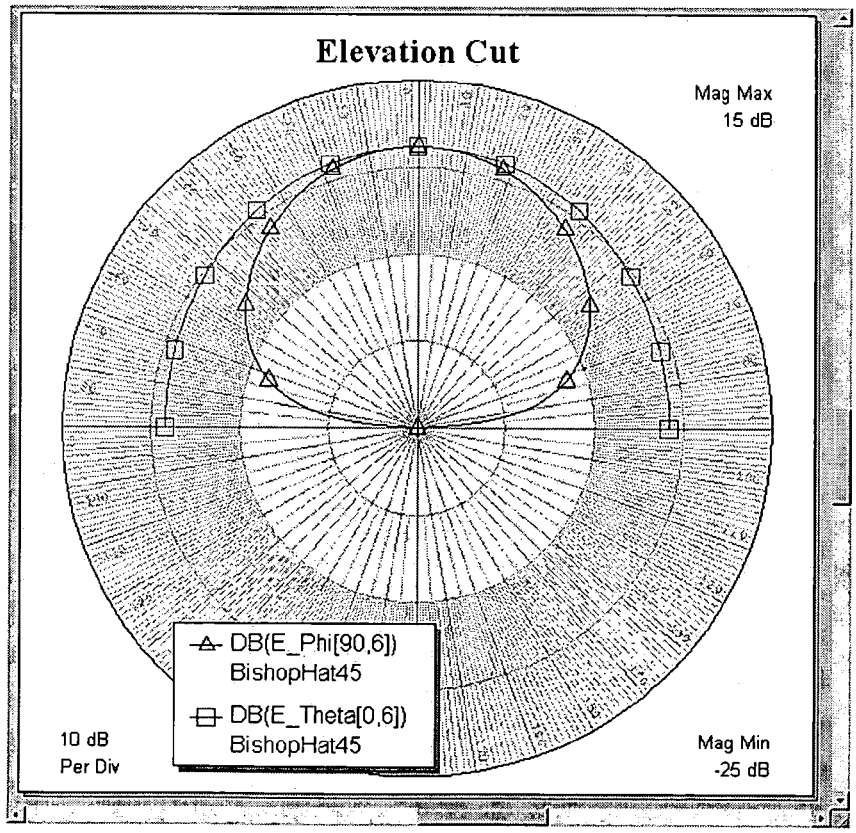

Initially, the angle subtended at the centre was set to 90 degrees and this structure is shown in FIG. 9*a*. The simulated impedance is shown in the Smith chart of FIG. 9*b*; this plot has been normalised to a characteristic impedance, Zo, of 100 Ω so that the return loss plot (FIG. 9*c*) can be compared to others in a matched system. The S11 spread of impedance is much smaller than that of a simple dipole and provides ultrawideband operation. FIG. 9*d* shows that the radiation patterns are essentially that of a dipole.

As the skilled person will understand an ideal normalised impedance is +1.0 and high impedances are generally undesirable. In FIG. 9*b* the square points are spaced 1 GHz apart over the range 2 GHz to 12 GHz and it can be seen that the modulus of the impedance is less than unity above approximately 2.5 GHz.

In this Smith chart and return loss plot, and in those that follow, the frequency range is from 2 GHz to 12 GHz.

Figure 10A:
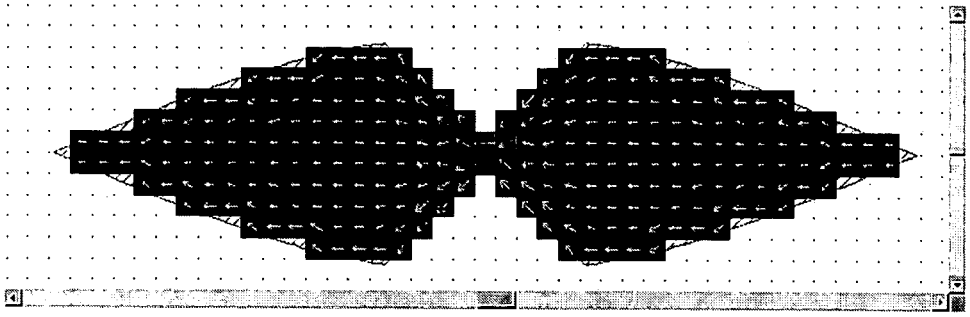
FIGS. 10*a* to 10*c* show current density plots at 3 GHz, 6 GHz and 10 GHz respectively for the 90° Bishop's Hat structure of FIG. 9*a;*
Figure 10B:
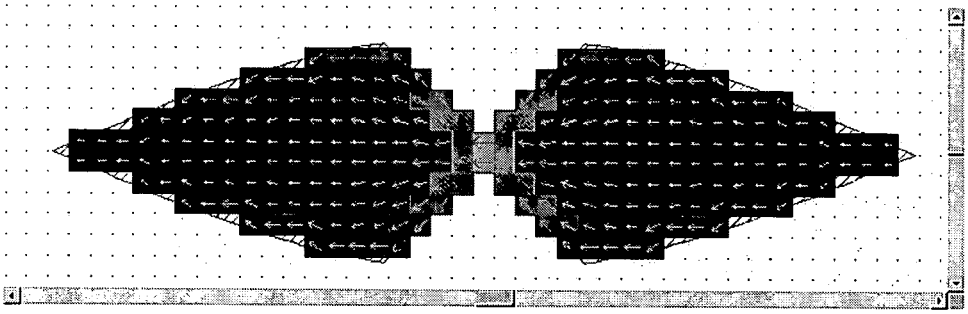
Figure 10C:
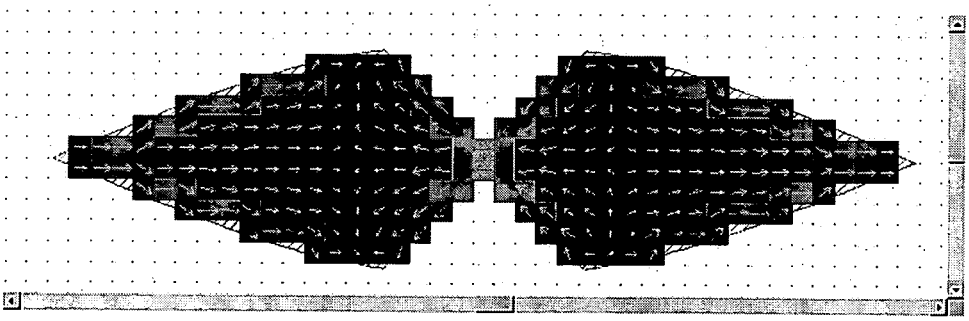

FIGS. 10*a* to 10*c* show the current density results at different frequencies; all are shown at zero phase. In these (and subsequent similar plots) light areas (long arrows) show regions of relatively high current density and dark regions (short arrows) regions of relatively lower current density. The skin effect is apparent forcing the current to flow more in the outer edges of the conductors. Nonetheless the centre of the structure is important and if, for example, this is removed leaving a form of loop or ring the antenna ceases to work properly.

Figure 11A:
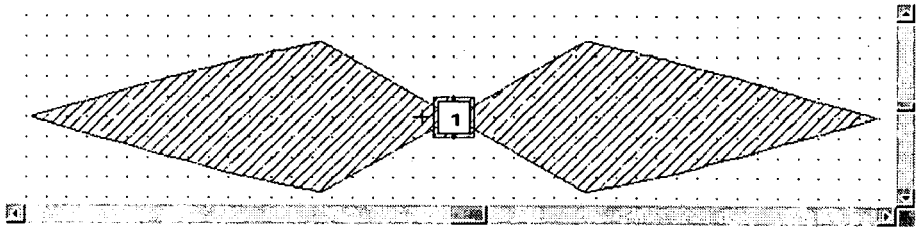
FIGS. 11*a* and 11*b* show, respectively, a 60° Bishop's Hat structure and an impedance chart (Zo=200 Ω) for the structure.
Figure 11B:
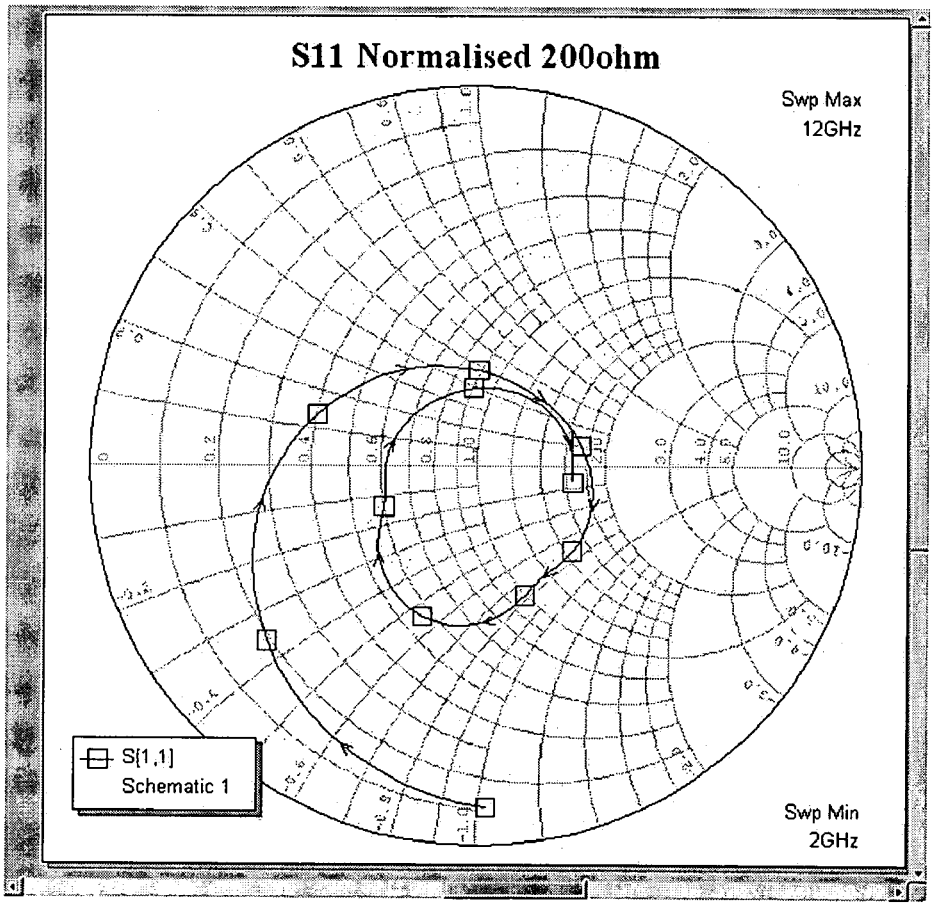

The angle subtended at the centre was then reduced to 60° (FIG. 11*a* depicts this structure) and the simulations repeated. For conciseness, the principal plane radiation patterns are not shown as they are essentially the same as the 90° case. The impedance plot is shown in FIG. 11*b* and shows that the average impedance has increased to around 200 Ω.

Figure 12A:
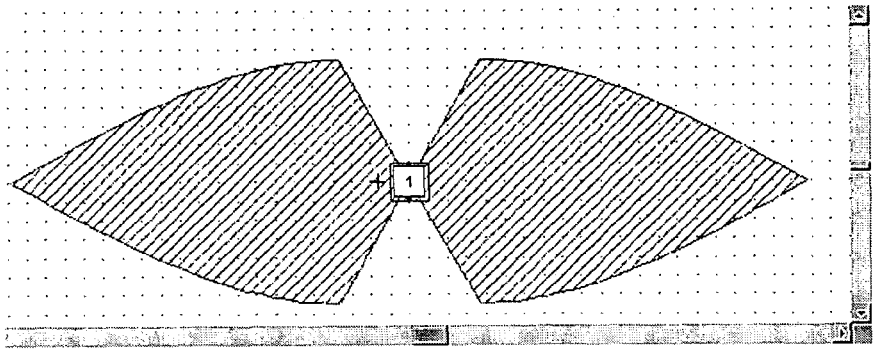
FIGS. 12*a* and 12*b* show, respectively, a 120° Bishop's Hat structure and an impedance chart (Zo=110 Ω) for the structure.
Figure 12B:
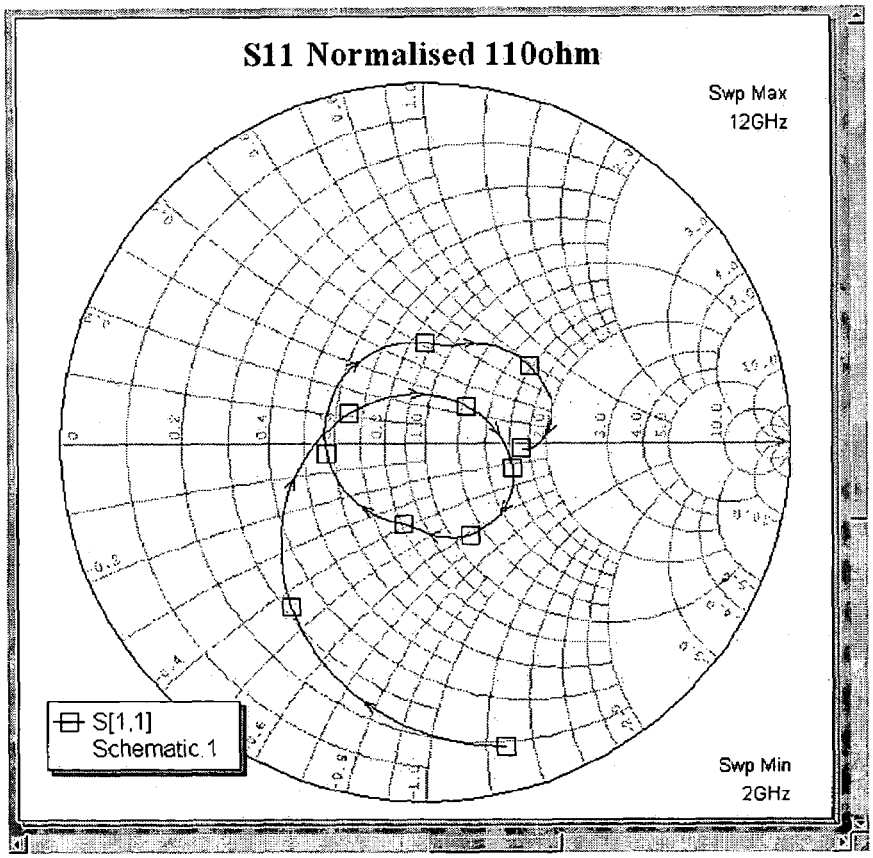

A third variant of a Bishop's Hat antenna (FIG. 12*a*) with an angle subtended at the centre of 120° was simulated. The Smith chart showing input impedance of the 120° Bishop's Hat antenna has been normalised to 110 Ω and is shown in FIG. 12*b*.

Figure 13:
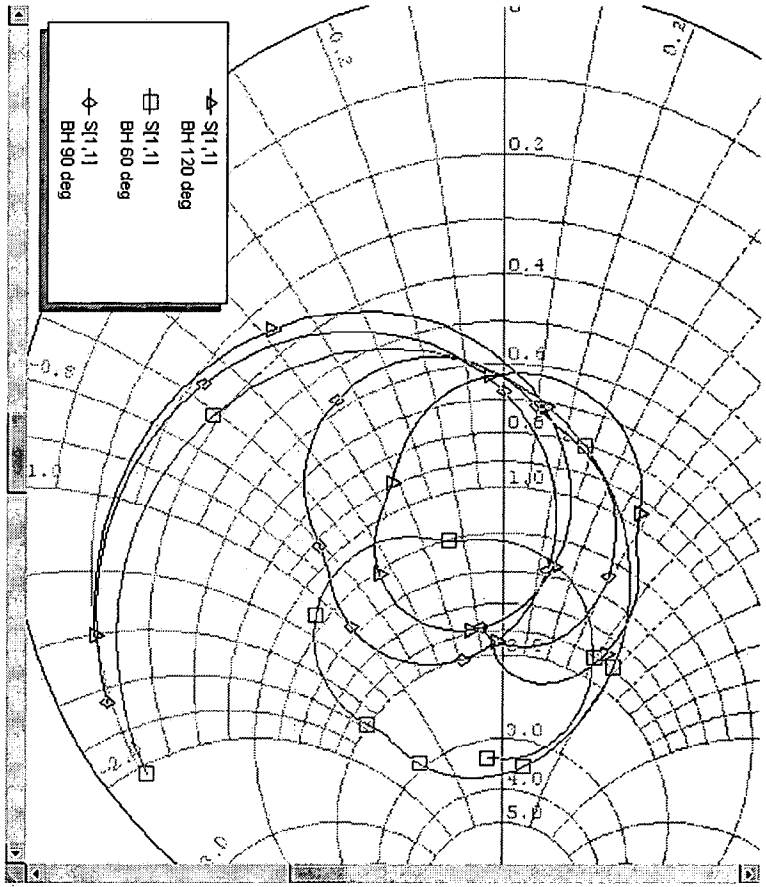
FIG. 13 shows an impedance chart (Zo=100 Ω) comparing the performances of 60° 90° 120° Bishop's Hat structures.
Figure 14A:
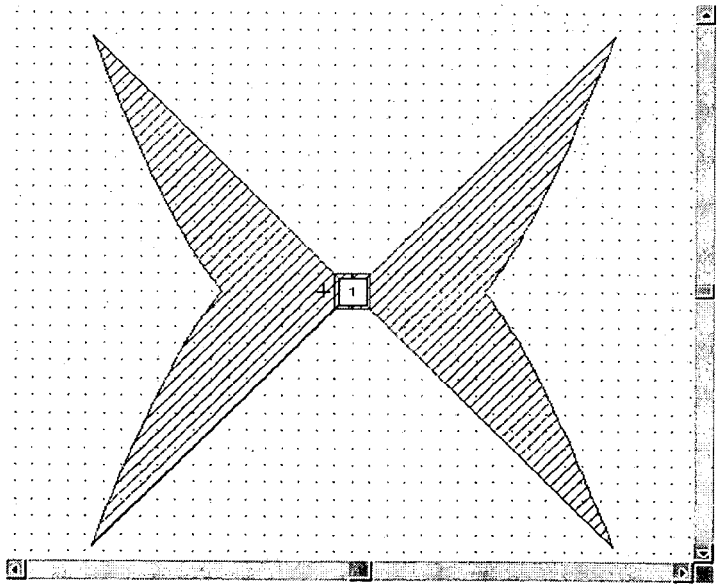
FIGS. 14*a* to 14*d* show, respectively, a 90° Wing structure and an impedance chart (Zo=140 Ω), a return loss plot (Zo=140 Ω), and responses of principal planes of the structure.
Figure 14B:
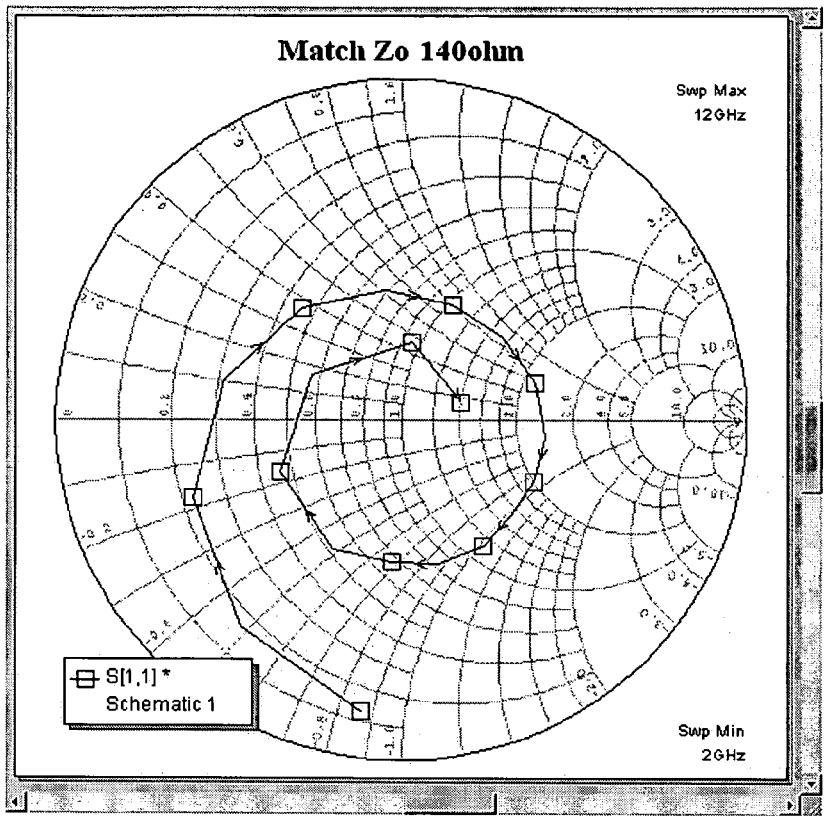
Figure 14C:
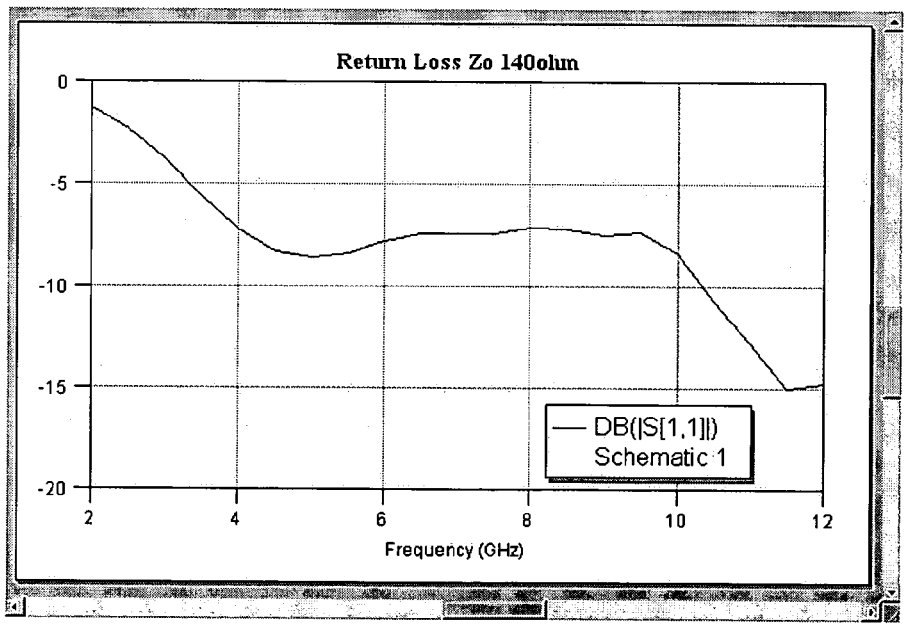
Figure 14D:
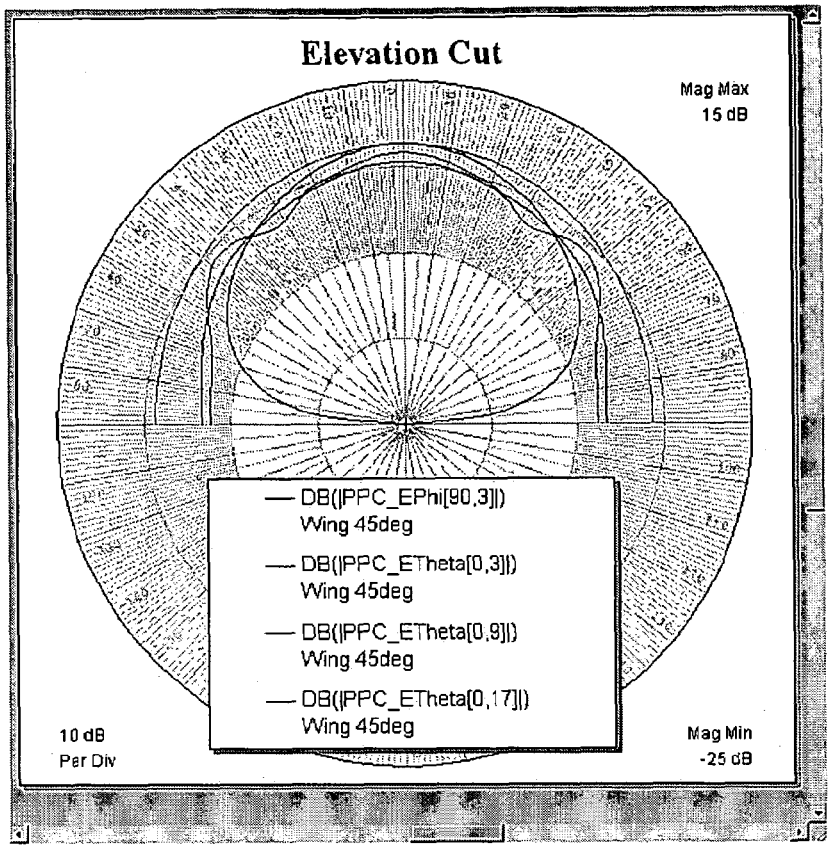
Figure 15A:
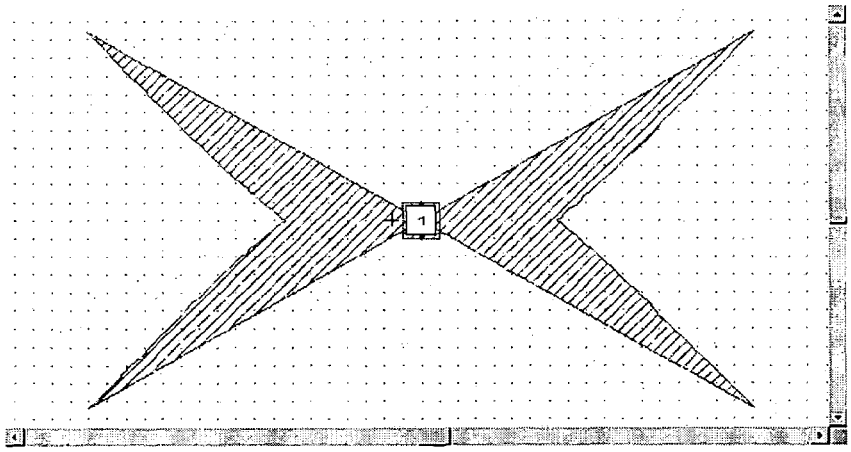
FIGS. 15*a* to 15*c* show, respectively, a 60° Wing structure and an impedance chart (Zo=140 Ω) and return loss plot (Zo=140 Ω) for the structure.
Figure 15B:
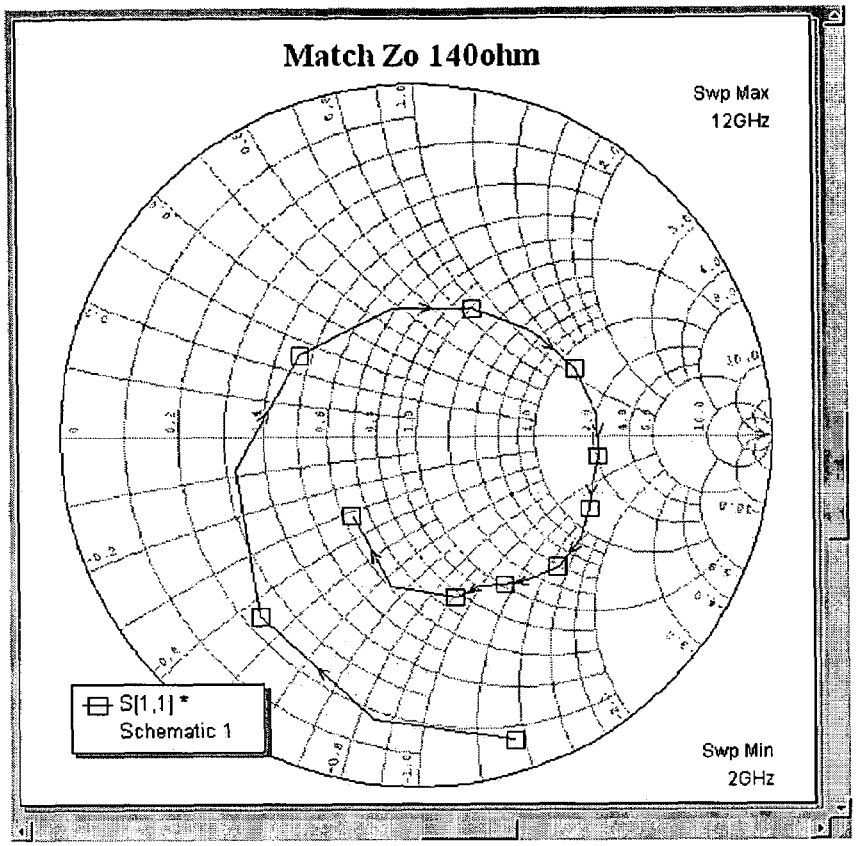
Figure 15C:
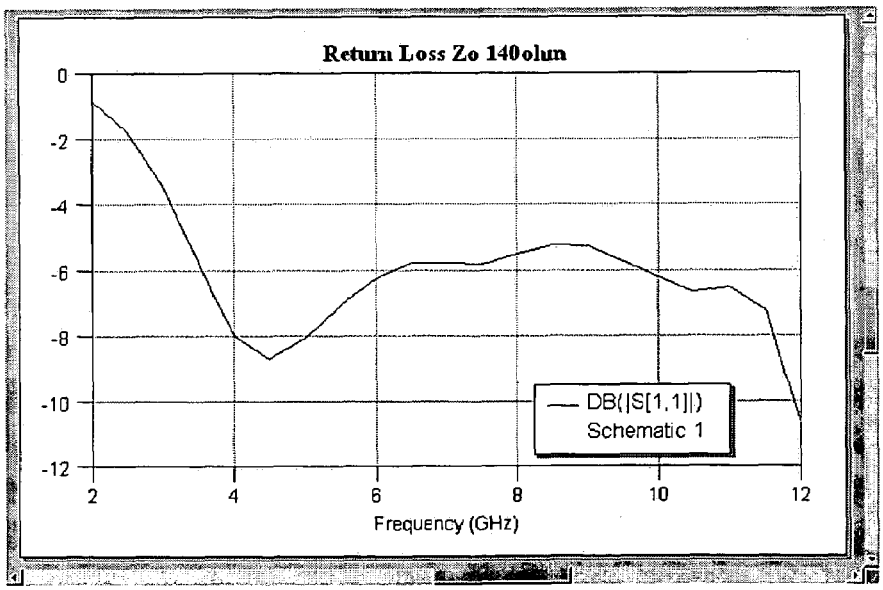
Figure 16A:
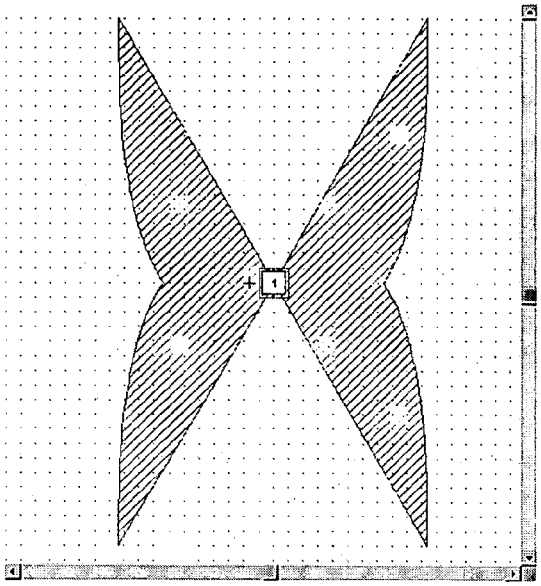
FIGS. 16*a* to 16*c* show, respectively, a 120° Wing structure and an impedance chart (Zo=140 Ω) and return loss plot (Zo=140 Ω) for the structure.
Figure 16B:
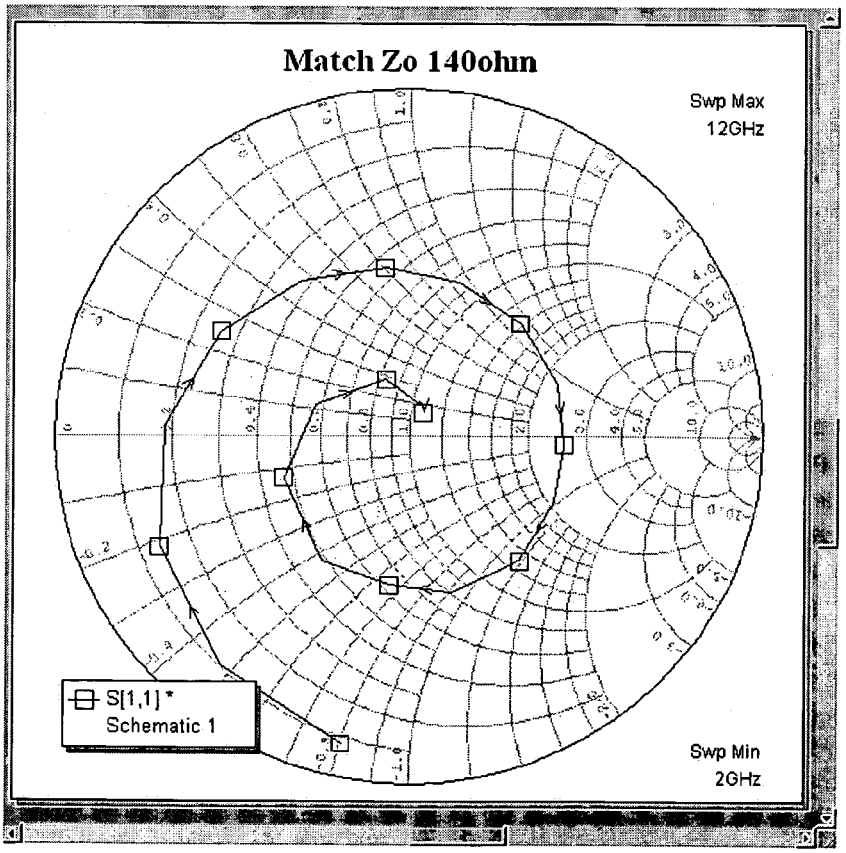
Figure 16C:
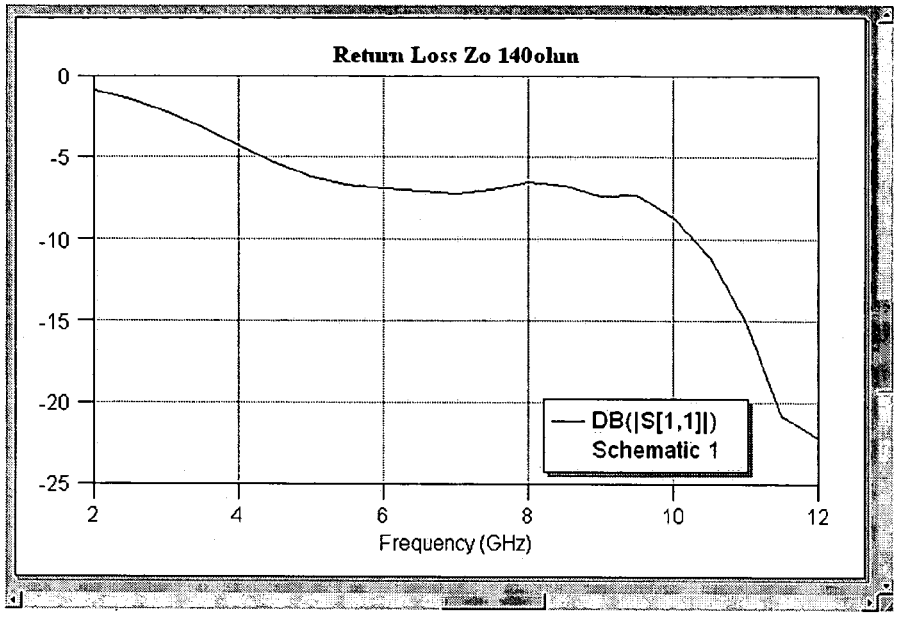
Figure 17:
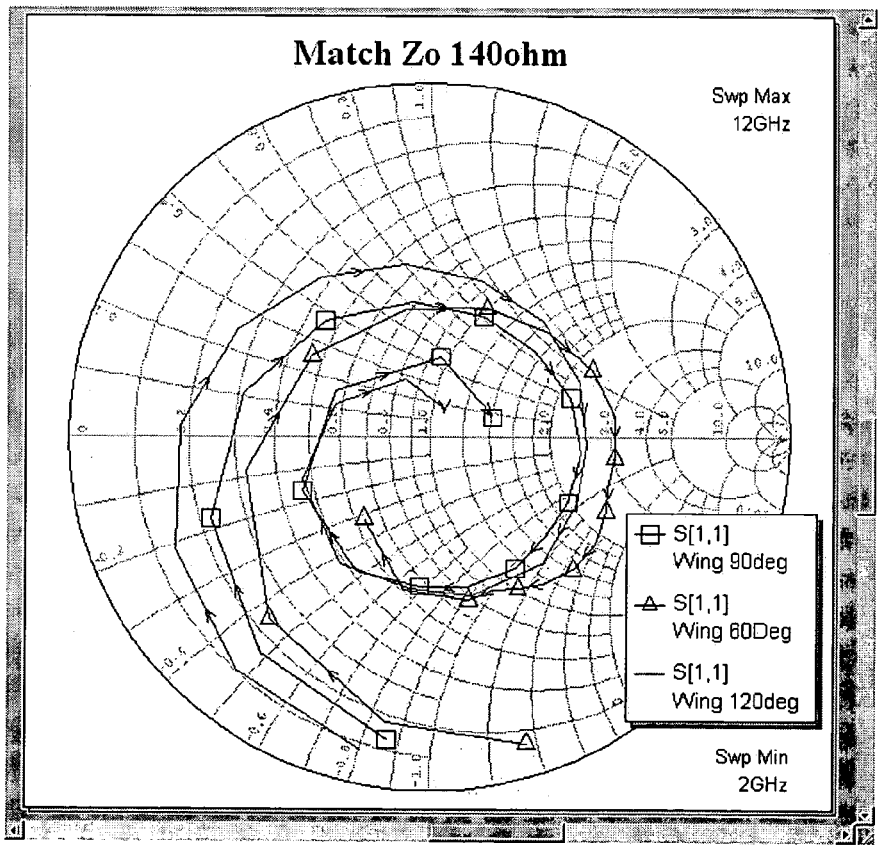
FIG. 17 shows an impedance chart (Zo=140 Ω) comparing the performances of 60° 90° 120° Wing structures.
Figure 18A:
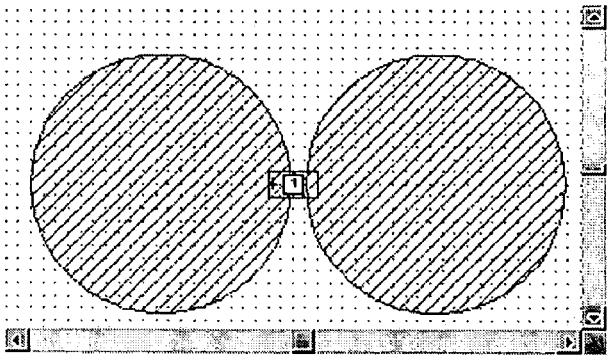
FIGS. 18*a* to 18*d* show, respectively, a circular dipole antenna structure and an impedance chart (Zo=100 Ω), a return loss plot (Zo=100 Ω), and responses of principal planes of the structure.
Figure 18B:
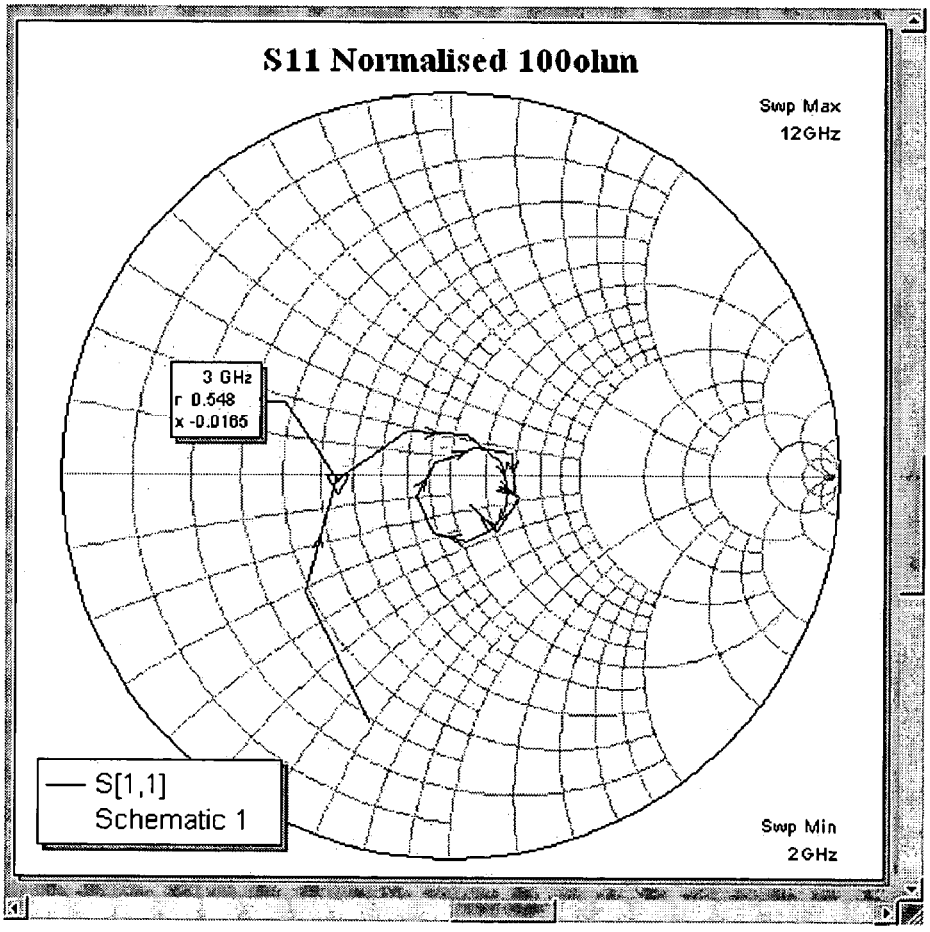
Figure 18C:
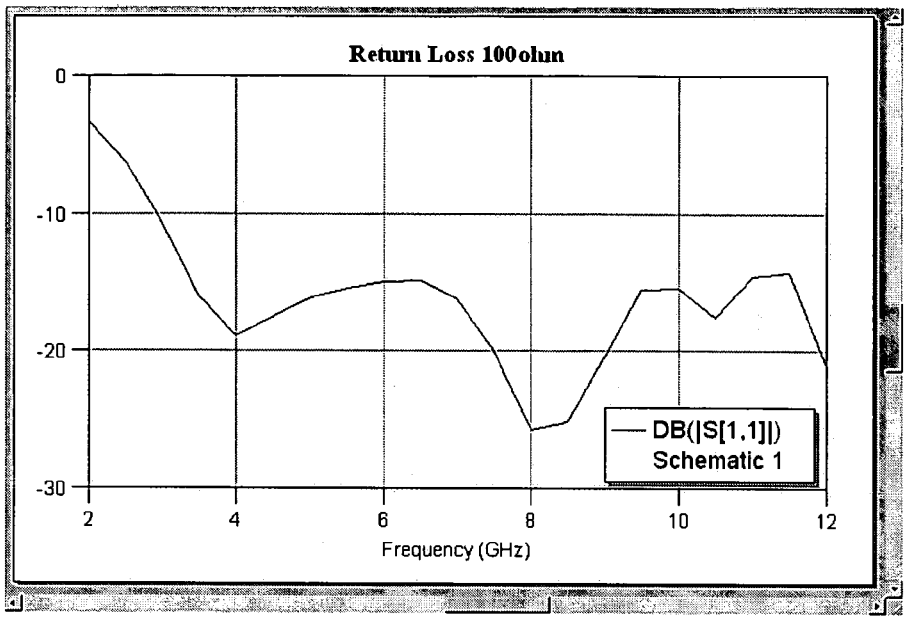
Figure 18D:
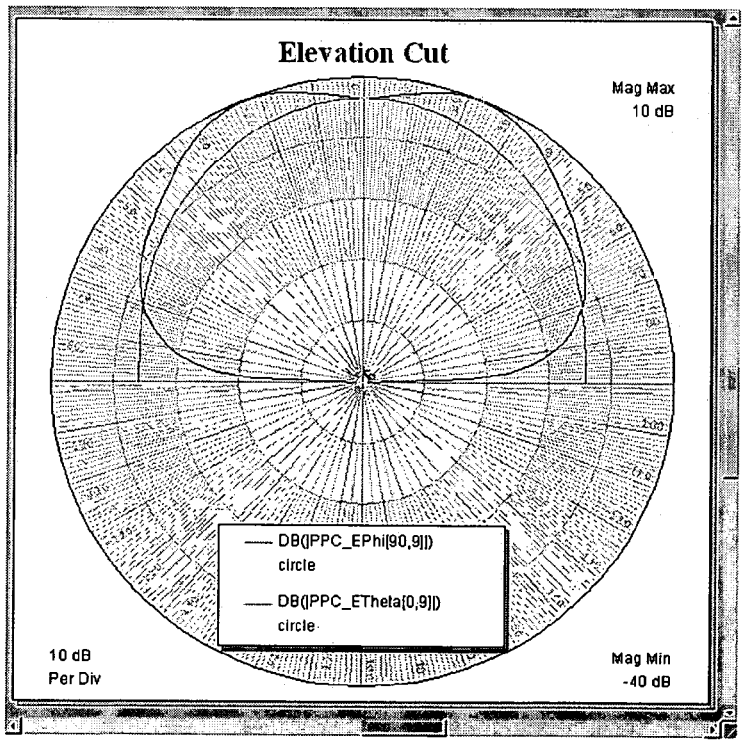
Figure 19:
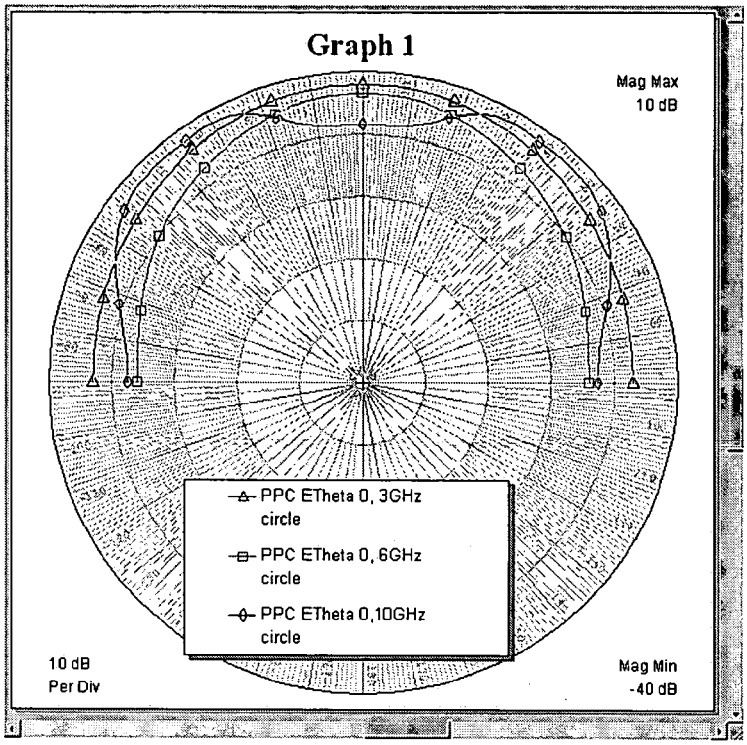
FIG. 19 shows antenna radiation patterns against frequency at 3 GHz, 6 GHz and 10 GHz for the 90° circular dipole antenna structure of FIG. 18*a;*

It is informative to plot all three impedance responses on a single Smith chart, as shown in FIG. 13 (normalisation impedance is 100 Ω; diamond is 90°; square is 60°; triangle is 120°). It can be seen that the 60° antenna is relatively high impedance, the 90° and 120° plots are quite similar. Closer inspection reveals that the 120° antenna impedance appears better in the low and middle frequencies, but not as good as the 90° antenna in the high frequencies.

As previously mentioned a mathematical dual of the Bishop's Hat antenna exists where the positions of the maximum and minimum lengths are transposed. This structure is here called the Wing. As in the case of the Bishop's Hat antenna, three different versions of the Wing structure were simulated, namely with angles subtended at the centre of 60°, 90° and 120°. The results are shown in FIGS. 14 to 17 (in FIG. 17 square is 90°; triangle is 60°; no markers is 120°). For conciseness, the principal plane radiation patterns are not shown included as they are essentially the same as the 90° case.

Following simulation of the Bishop's Hat antenna, a circular antenna was studied as, viewed from one perspective, this provides an infinite set of dipoles fed from a single point and as such potentially offers low dispersion characteristics. A broadband antenna should preferably present a smooth transition from the guided wave to the free-space wave, as this should result in a non-resonant, low-Q radiator with a constant input impedance. The circular dipole structure shown in FIG. 18*a* was therefore simulated; the results are depicted in FIGS. 18*b* to 20. (The normalising impedance is 100 Ω; in FIG. 19 square is 6 GHz; triangle is 3 GHz; diamond is 10 GHz).

The results above show that a circular antenna can advantageously be used in UWB systems—the antenna presents a near constant impedance across a very large bandwidth, the low frequency response being well defined by the diameter of the circle. The antenna radiation patterns are again similar to those of a dipole.

Figure 21A:
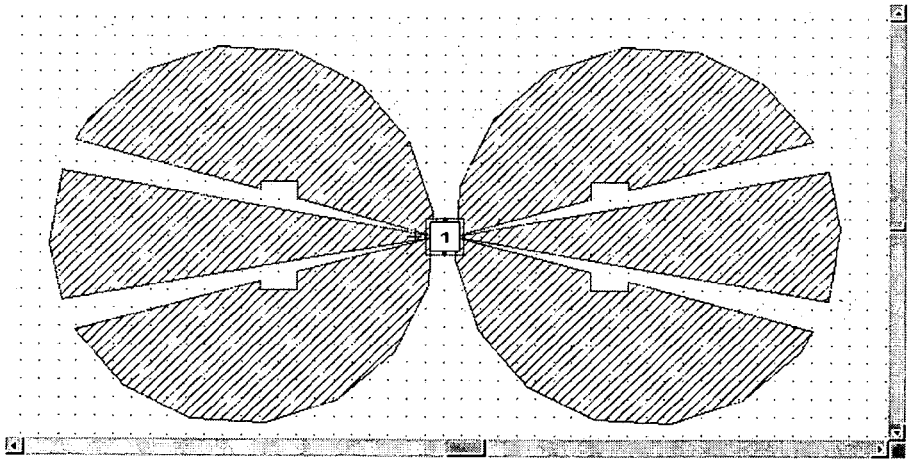
FIGS. 21*a* to 21*c* show, respectively, a slotted circular dipole antenna structure and an impedance chart (Zo=140 Ω) and return loss plot (Zo=140 Ω) for the structure.
Figure 20A:
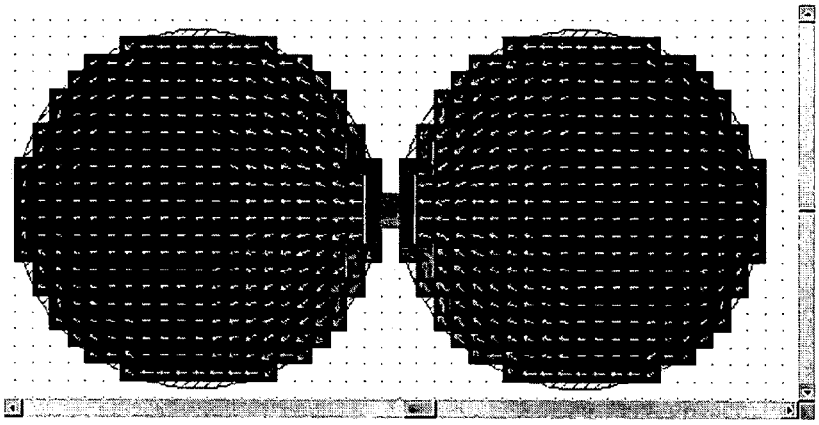
FIGS. 20*a* to 20*c* show current density plots at 3 GHz, 6 GHz and 10 GHz respectively for the circular dipole antenna structure of FIG. 18*a;*
Figure 20B:
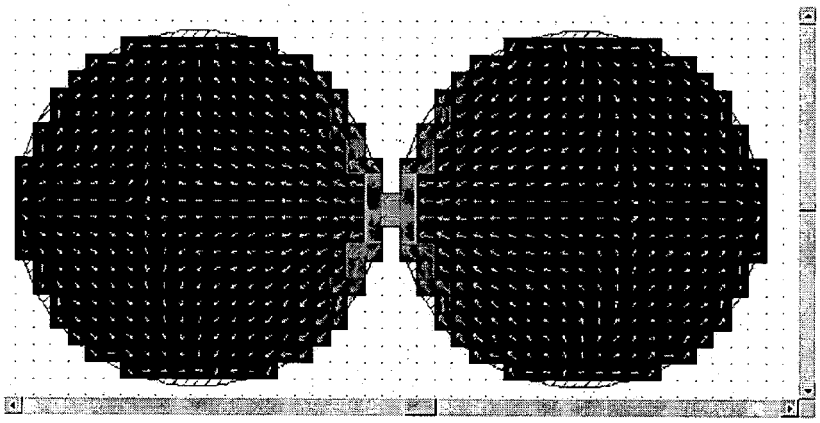
Figure 20C:
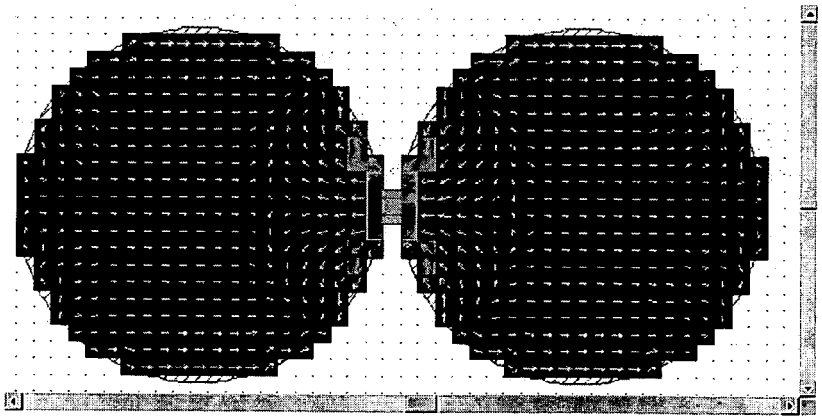
Figure 21B:
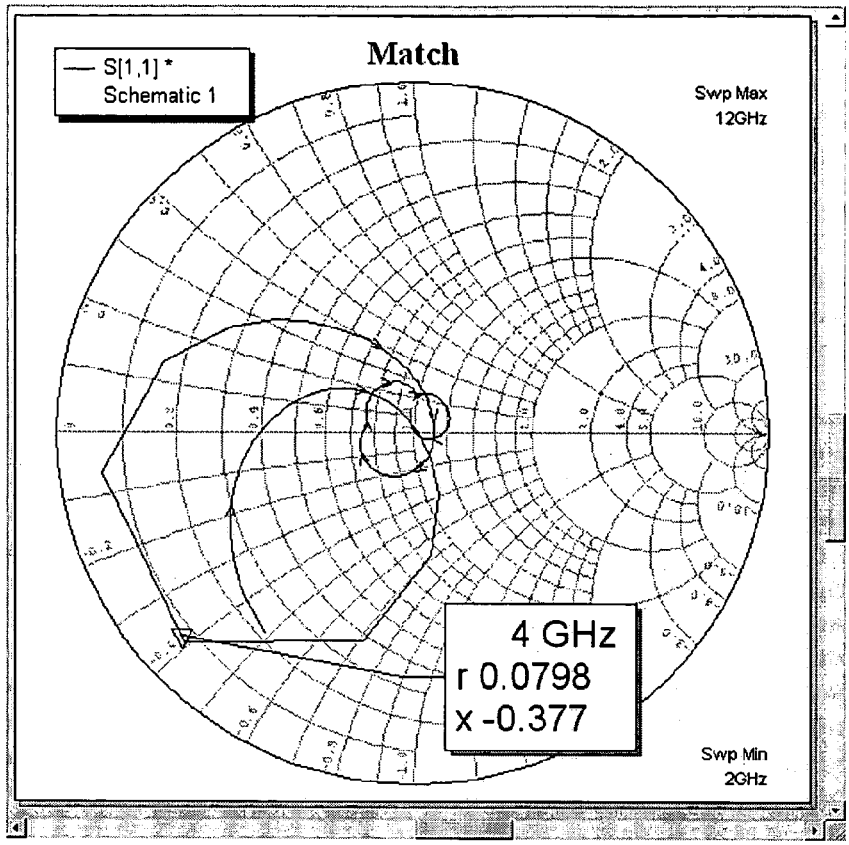
Figure 21C:
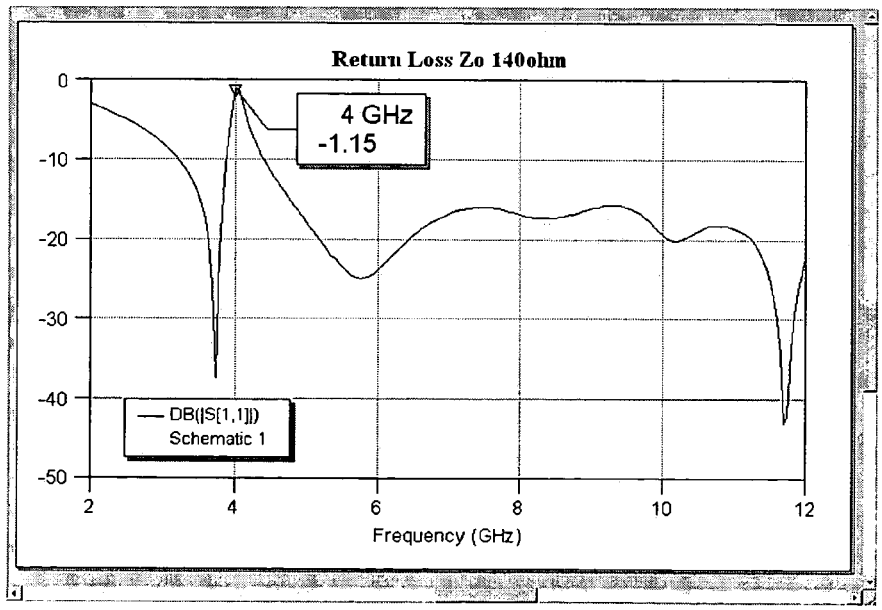
Figure 22A:
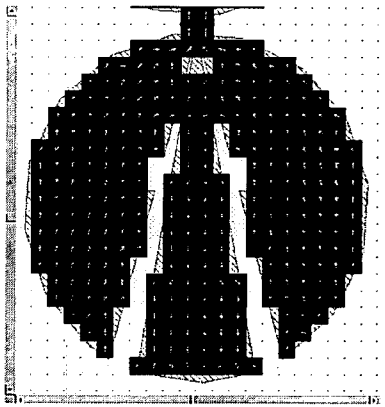
FIGS. 22*a* to 22*c* show current density plots at 4 GHz at respective phases of 0°, 90°, 180°, and 270° for the slotted circular dipole antenna structure of FIG. 21*a;*
Figure 22B:
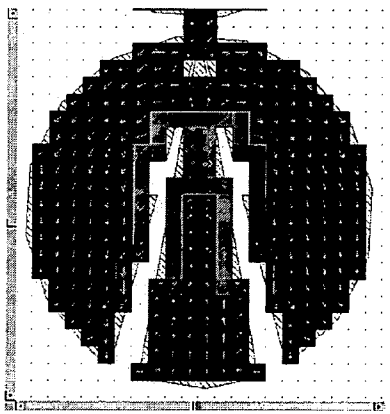
Figure 22C:
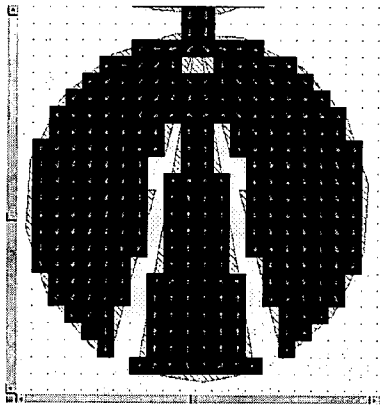
Figure 22D:
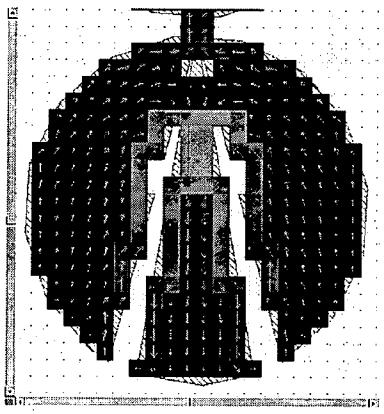

Slots can be incorporated in a circular antenna to reject unwanted interfering signals, as shown in FIG. 21*a*. Symmetrical slot positions were chosen and an EM simulation performed (the extra notches in FIG. 21*a* were merely introduced to prevent the slots shorting out when the antenna shape was modelled on a square grid). Impedance and return loss plots are shown in FIGS. 21*b* and 21*c* respectively; the skilled person will understand that FIG. 21*c* comprises a representation of the real part of FIG. 21*b* and that the lower the return loss the better, the peak corresponding to a 4 GHz reject notch. FIGS. 21*b* and 21*c* show that a good match is obtained at frequencies above $F_{min}$, with the exception of a narrow band of frequencies around 4 GHz. The length of the slot is relatively large which results in the low band reject frequency. In this example reducing the slot length, by rotating the open ends towards the feed point increases the band reject frequency.

Figure 23A:
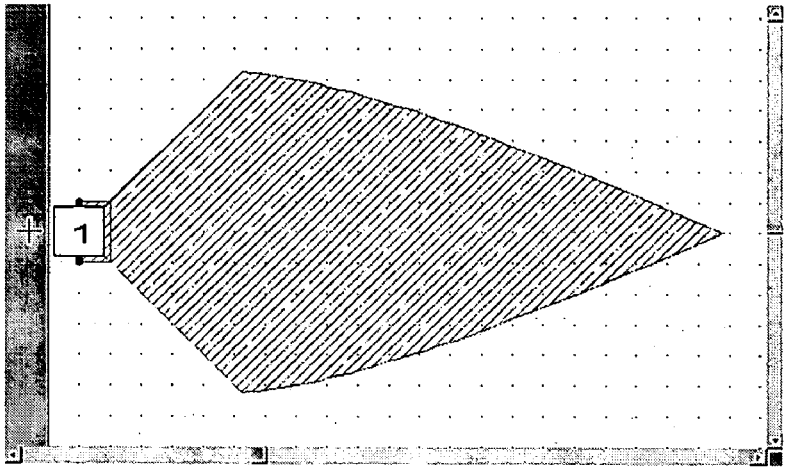
FIGS. 23*a* to 23*c* show, respectively, a monopole 90° Bishop's Hat antenna and an impedance chart (Zo=100 Ω), and responses of principal planes of the antenna.
Figure 23B:
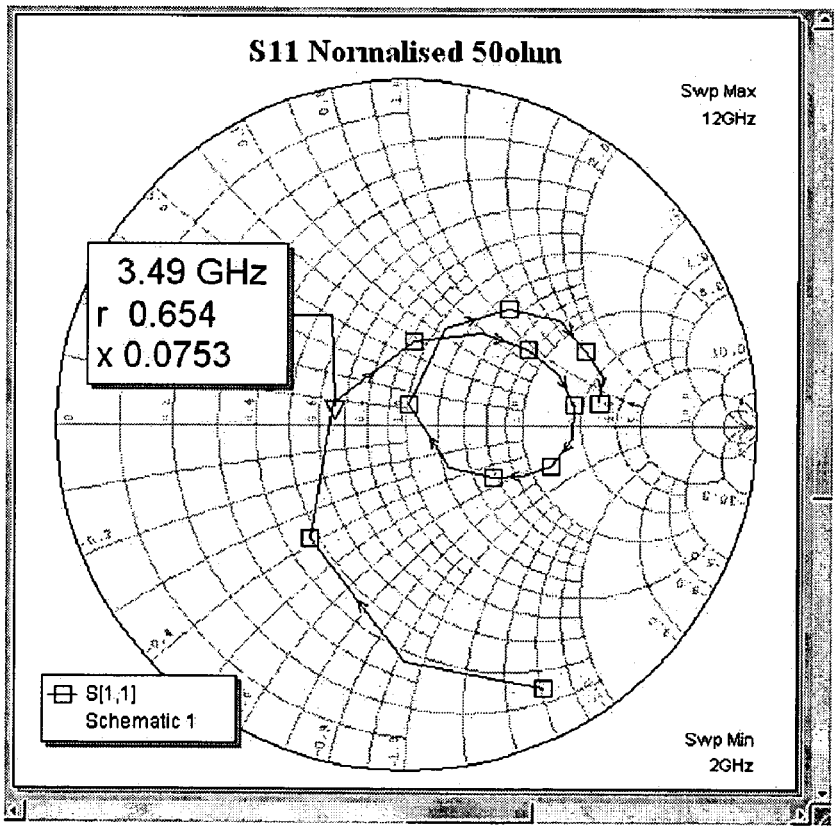
Figure 23C:
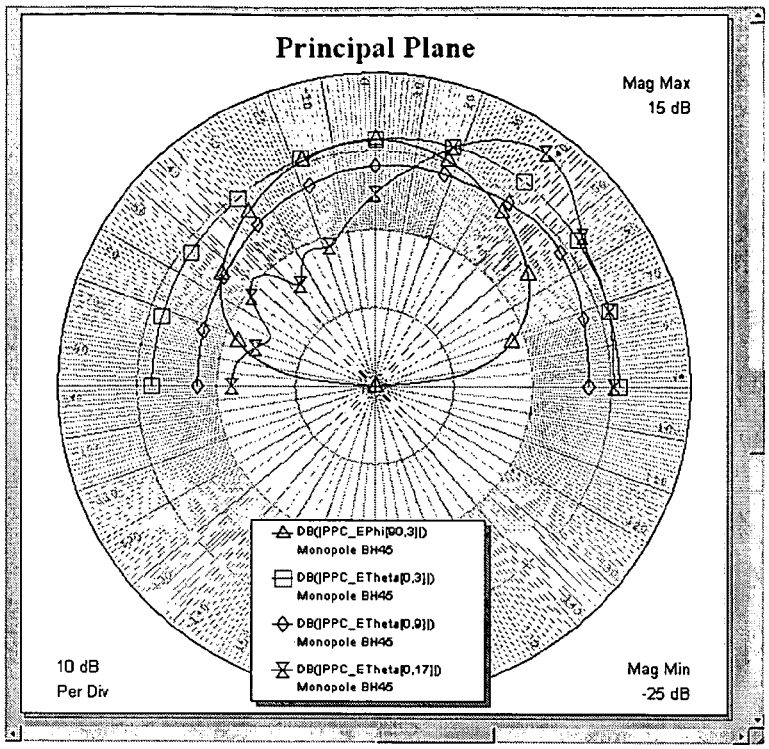
Figure 24A:
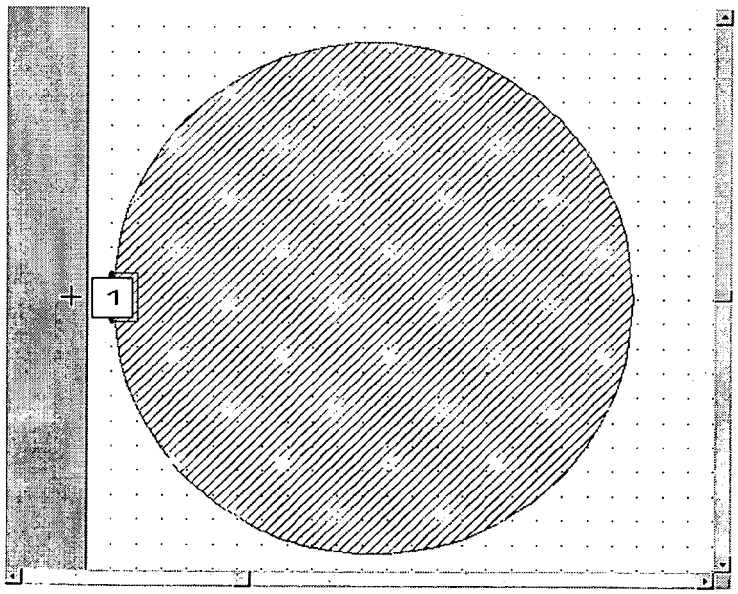
FIGS. 24*a* to 24*c* show, respectively, a monopole circular antenna and an impedance chart (Zo=100 Ω), and responses of principal planes of the antenna.
Figure 24B:
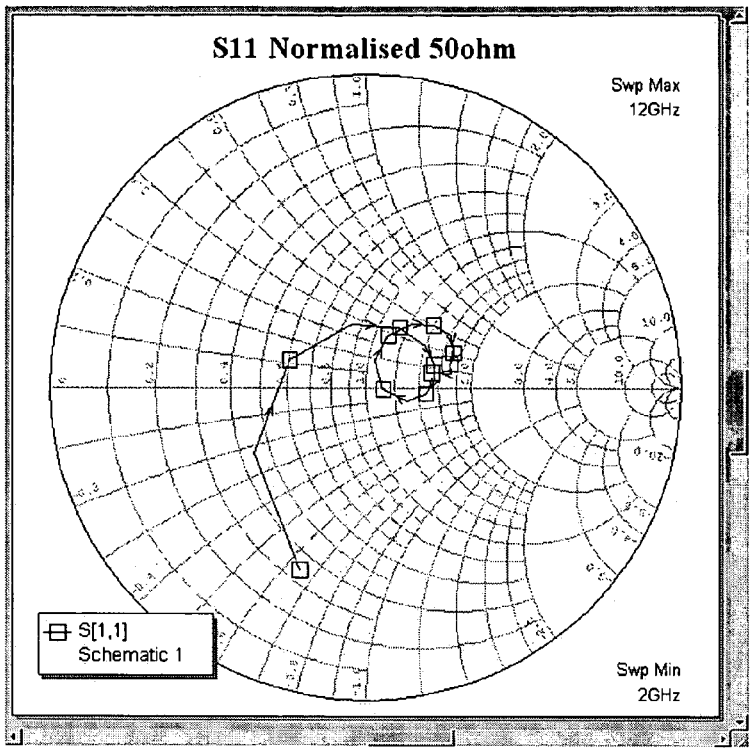
Figure 24C:
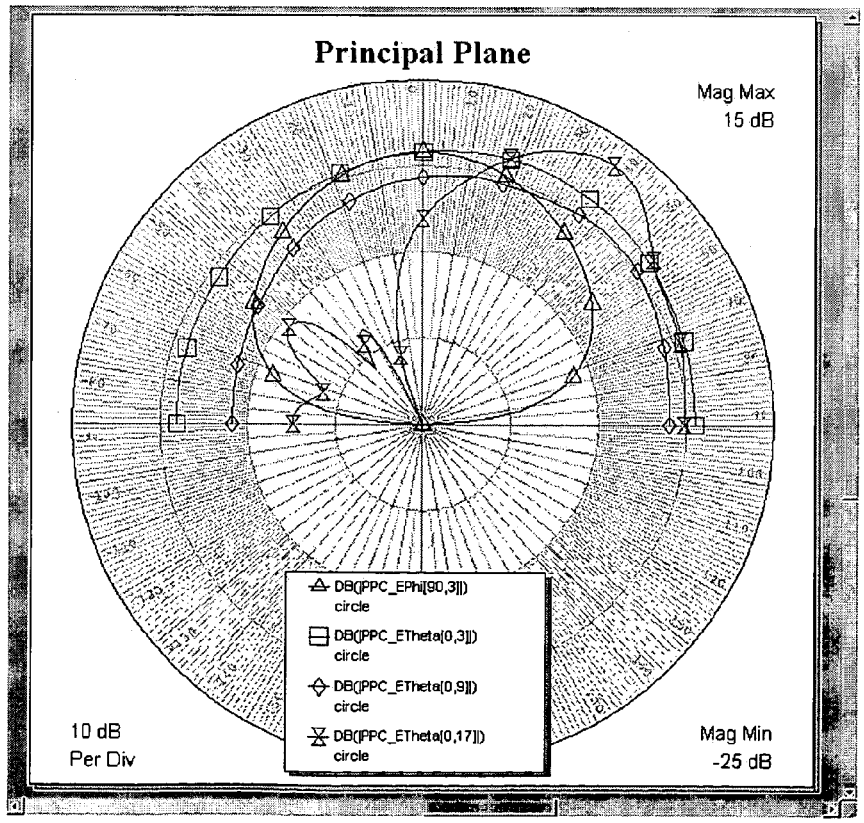

The next antennae to be considered are the monopoles, which can easily be connected to a 50 Ω system, such as a 50 Ω transmission line, a length of coaxial cable, or a printed microstrip, for measurement. Results for Bishop's Hat monopoles are shown in FIGS. 23*a-c*, and for a circular antenna in FIGS. 24*a* to 24*c*.

Figure 25:
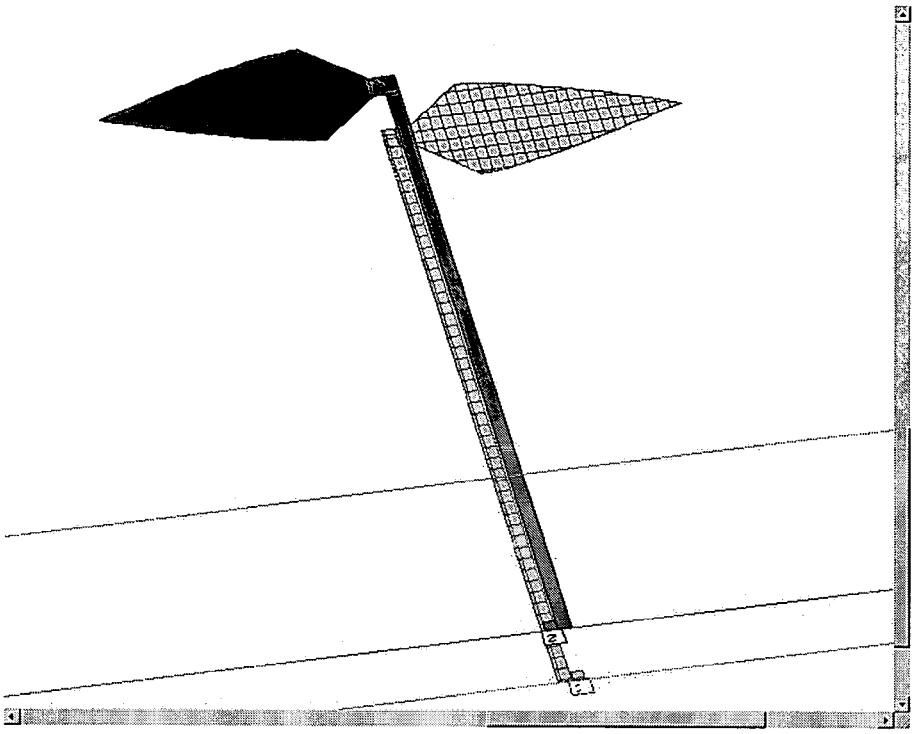
FIG. 25 shows a substrate-mounted dipole Bishop's Hat antenna.

FIG. 25 shows an antenna suited to fabrication on a PCB, which is desirable, for example, for PCMCIA based products. Typically, PCBs have a dielectric constant (Er) in the range 2<Er<5 and this should be taken into effect, as it will reduce the physical dimensions of the antenna structure. Using a ceramic substrate can further reduce the size of the antenna.

Mounting a ground plane orthogonal to the antenna element is awkward in a PCMCIA module and a dipole antenna suits PCMCIA requirements better. A balanced feed can either be implemented by feeding a single-ended transmitter through a UWB balun, or by employing a transmitter with a balanced output signal (two signals of 180° phase difference between them). Using an EM simulator, the effect of the proximity of any other conductors can be considered, for example, a metal case of the PCMCIA module, laptop or PC, or other adjacent circuitry on the PCB. Each half of the dipole may be etched onto opposite sides of the PCB, thus allowing a symmetric broadside-coupled stripline to be used for the balanced feed. The apparent offset is merely a result of perspective; ideally the two feed lines are substantially opposite one another (thus providing a greater area of overlap than if they were side by side, when they would only face one another across a width equal to the thickness of the copper).

Measurements were made taken on various antennae with an Anritsu 37347A Network Analyser. It should be noted however, that measuring path loss in a laboratory rather than an anechoic chamber can be problematic. Multiple reflections from nearby metal structures or equipment may influence the results.

Figure 26A:
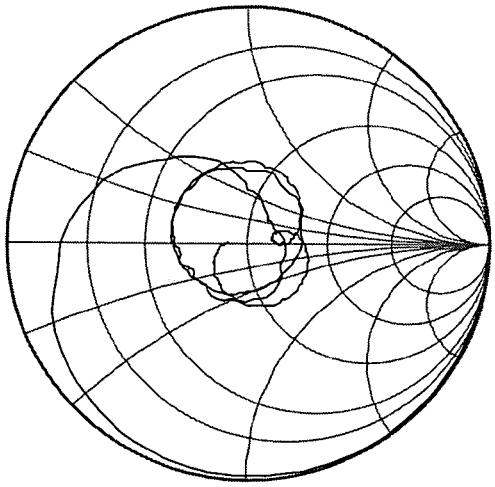
FIGS. 26*a* to 26*c* show, respectively, an impedance chart, measured S-parameters, and measured S21 group delay for a monopole Bishop's Hat antenna.
Figure 26B:
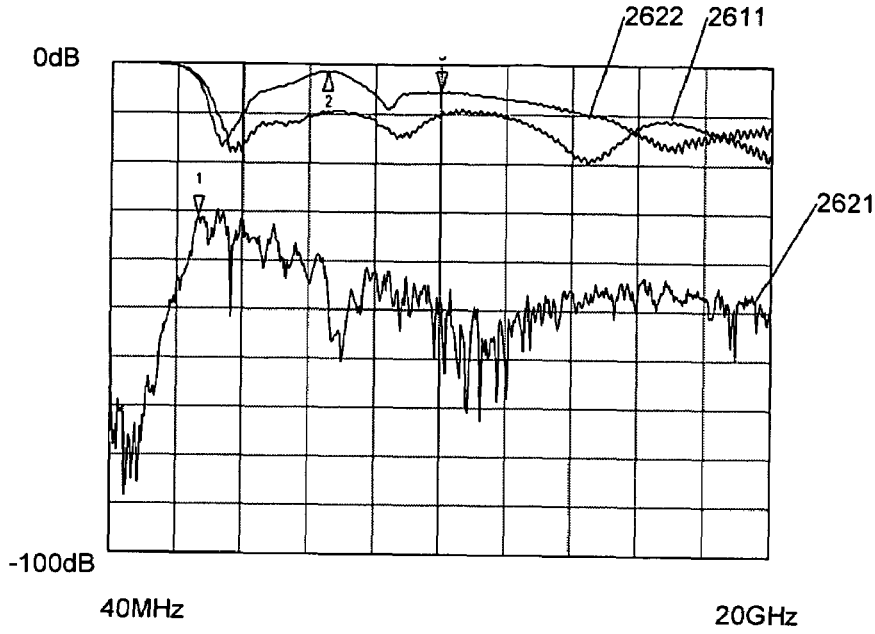
Figure 26C:
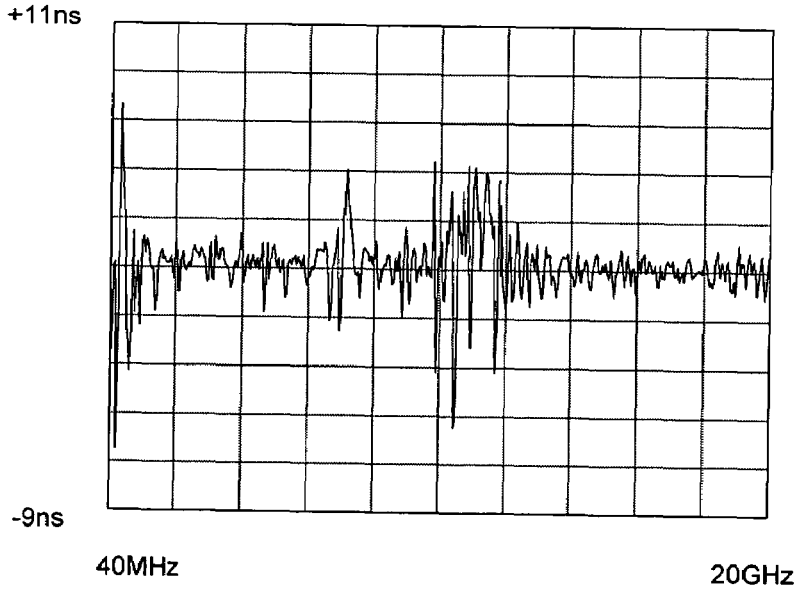
Figure 27:
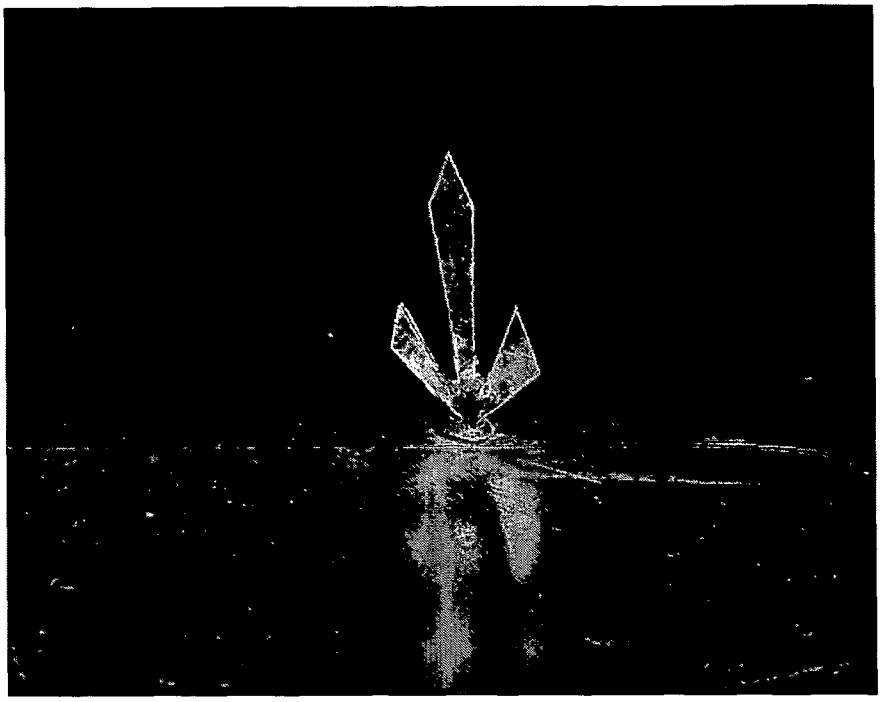
FIG. 27 shows a photograph of an example of a slotted monopole Bishop's Hat antenna.

A prototype Bishop's Hat (monopole configuration) was manufactured from copper sheet and mounted above a ground-plane of 56.25 $cm^2$. The antenna was connected directly to a 50 Ω SMA connector whereby S11 could be measured (FIG. 26*a*, which shows the response from 40 MHz to 20 GHz). Two such antennae were connected to the two ports of the network analyser and set 30 cm apart; the antenna connected to port-2 was slotted to provide a frequency notch. The S-parameters were measured (refer to FIG. 26*b*—S21 2621, S11 2611, S22 2622) and S21 clearly shows the pass band of the antenna extending across the UWB frequency range, more attenuation is present at higher frequencies which is due to the natural −6 dB/octave free-space loss. Furthermore, a notch can be seen at around 6.6 GHz although this notch may be tuned to the 802.11 frequencies at 5.2 GHz. The free-space loss at 2.7 GHz for 30 cm is −30.6 dB, this agrees closely with that obtained above indicating that the antenna is in fact radiating with a horizontal gain of around −0.2 dBi (each antenna). Linear phase (constant group delay) is desirable for a low bit error rate; group delay is shown in FIG. 26*c* (note the excessive group-delay at the notch frequency). Noisy or high group-delay outside of the UWB band is a result of the analyser losing phase-lock due to low signal levels. FIG. 27 shows a photograph of a slotted Bishop's Hat monopole.

Figure 28A:
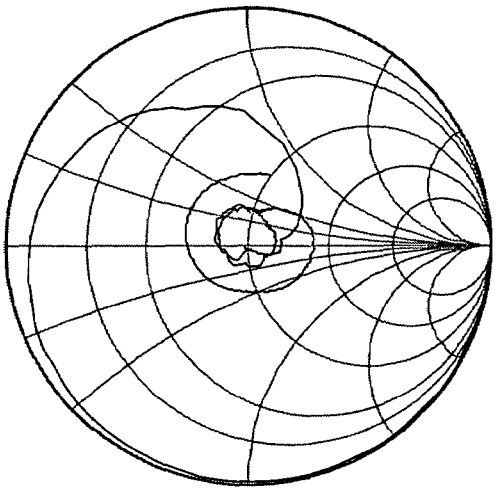
FIGS. 28*a* to 28*c* show, respectively, an impedance chart, measured S-parameters, and measured S21 group delay for a monopole circular antenna.
Figure 28B:
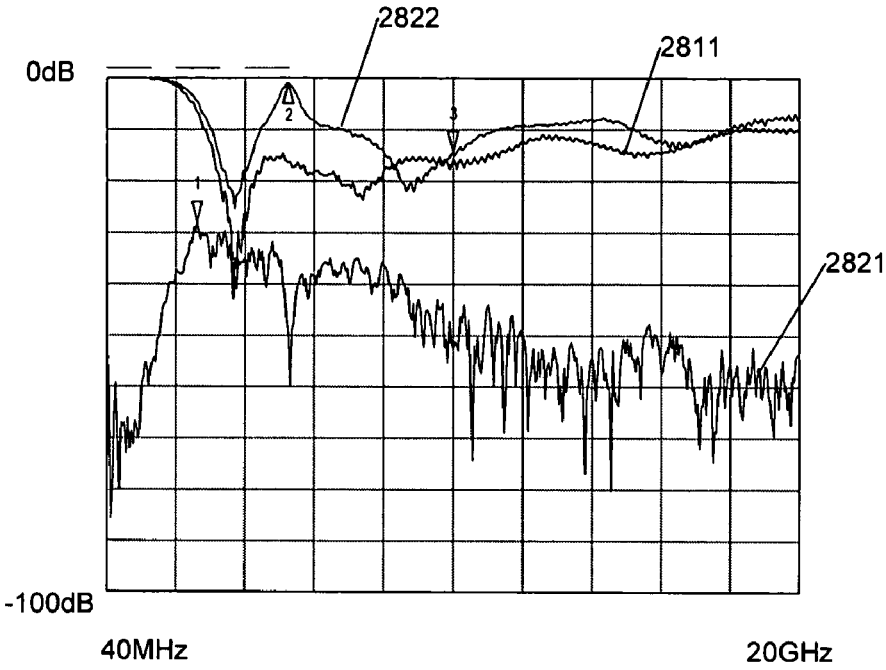
Figure 28C:
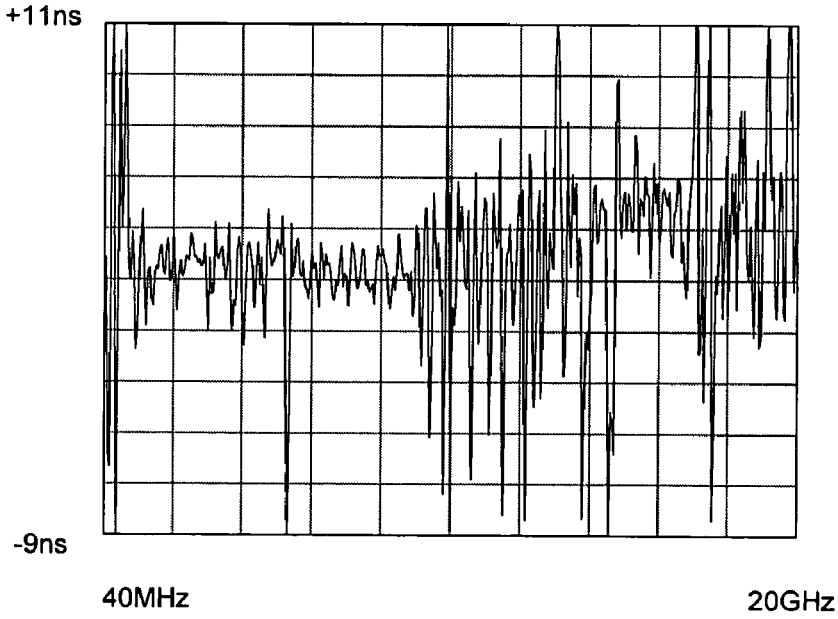

Referring to FIGS. 28*a-c*, in a circular monopole the diameter determines the low frequency response (around 3 GHz in this example). A prototype circular monopole of diameter 20 mm was mounted on the centre pin of an SMA connector above a ground-plane of 56.25 $cm^2$. FIG. 28*a* shows S11 (from 40 MHz to 20 GHz) in Smith Chart format and demonstrates a useful UWB response.

Two such circular antennae were positioned 30 cm apart and connected to the network analyser and the S-parameters were measured (refer to FIG. 28*b*—S21 2821, S11 2811, S22 2822). The circular antenna connected to port-2 of the analyser was slotted hence S22 has a high return loss (marker-2) and S21 has a notch in the response at 5.3 GHz in this case. Again, the magnitude of S21 at 2.6 GHz is −28 dB which agrees closely with the theoretical path loss of −30.3 dB, the antenna therefore has a gain of +1.1 dBi (each antenna).

The group-delay plot is shown in FIG. 28*c*; the large excursion at 5.3 GHz is due to the slots in one of the antennas. The average group-delay of around 1 ns is wholly due to the 30 cm separation between the antennae.

Figure 29A:
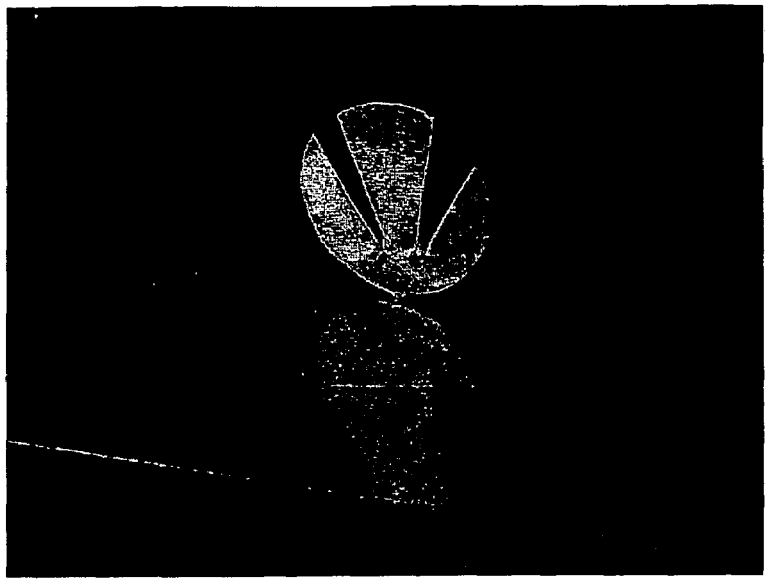
FIG. 29*a* shows a photograph of an example of a slotted monopole circular antenna.
Figure 29B:
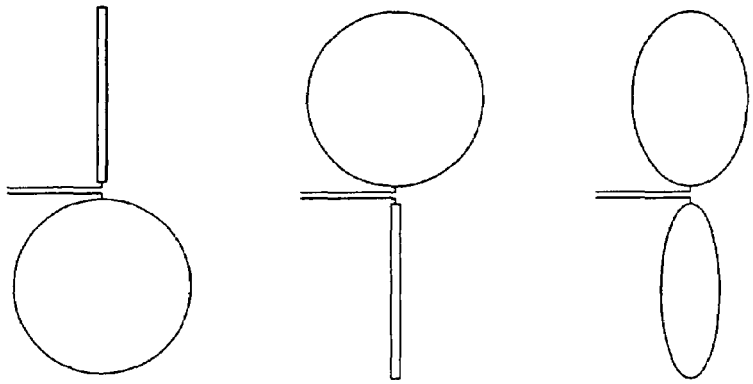
FIG. 29*b* shows three views of a twisted circular dipole UWB antenna.
Figure 30:
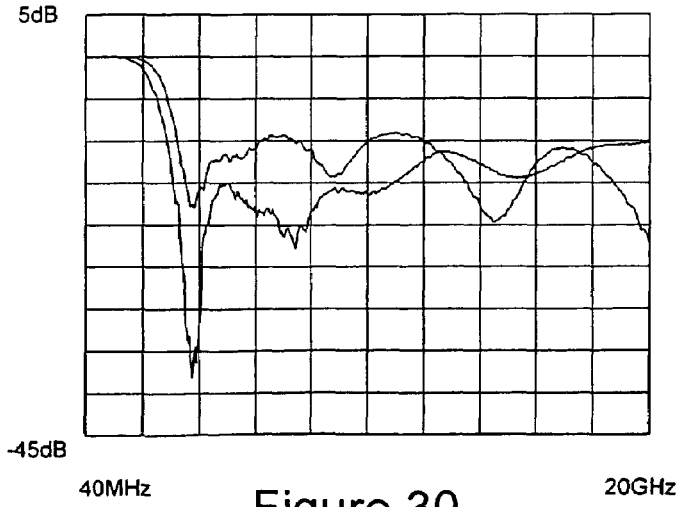
FIG. 30 shows return loss plots for a monopole Bishop's Hat antenna and for a monopole circular antenna.

FIG. 29*a* shows a photograph of an example of a slotted monopole circular antenna. FIG. 30 shows return loss plots comparing a monopole Bishop's Hat antenna (the upper trace at the low end of the frequency range) and a monopole circular antenna. FIG. 29*b* shows three views of a twisted circular dipole UWB antenna comprising a pair of antenna bodies in a dipole configuration in which the planes of the antenna bodies are twisted at substantially 90 degrees with respect to one another.

Figure 31A:
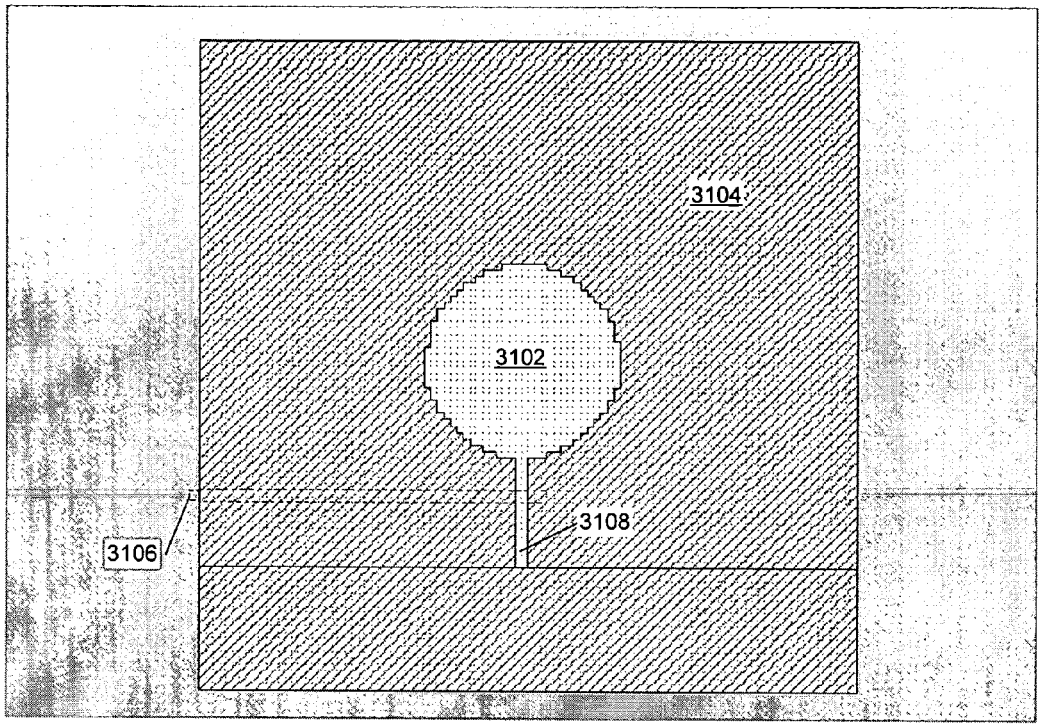
FIGS. 31*a* and 31*b* show, respectively, a view from above and a perspective view of a planar slot-driven UWB antenna comprising a disc-shaped aperture.
Figure 31B:
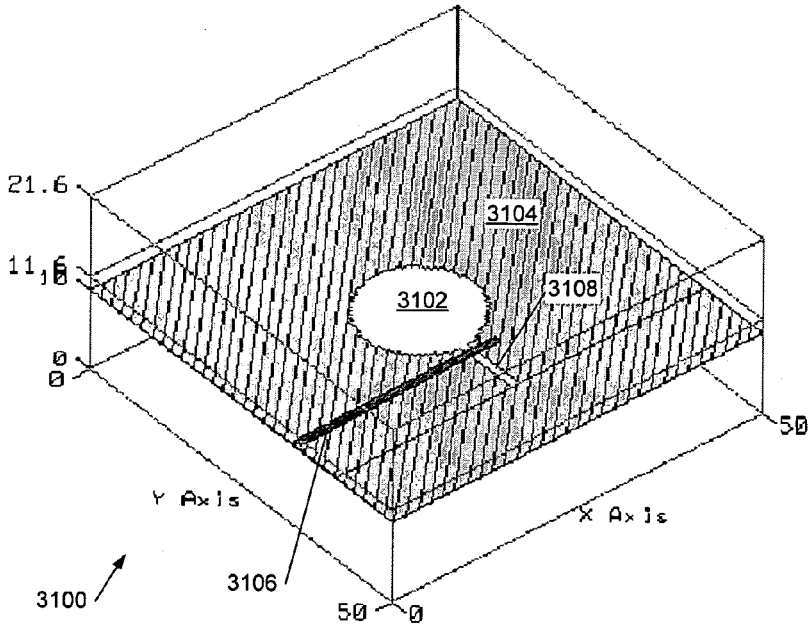

FIGS. 31*a* and 31*b* show a view from above and a perspective view of a planar slot-driven UWB antenna 3100 comprising a disc-shaped aperture 3102.

Referring to FIGS. 31*a* and 31*b* the antenna 3100 comprises a planar substrate formed from a sheet of dielectric material such as FR4 or RT-Duriod (but not restricted to these materials), sandwiched between a conducting plane 3104 defining the aperture 3102 and a feedstrip transmission-line 3106. The transmission line is capacitively coupled to a transverse slot-line 3108 that feeds the circular aperture antenna. The size of the circular aperture determines the frequency range of the antenna.

Embodiments of this omni-directional antenna may be single-ended (with respect to ground), and physically flat and hence easily fabricated at low cost. Embodiments are well suited to UWB applications and easily integrated onto a PCB with an associated transmitter or receiver.

Persons of ordinary skill in the art will appreciate that conducting transmission line elements may be formed on the substrate by numerous methods including plating, etching and other known deposition techniques. It is also well known in the art that a matching circuit (not shown) may easily be included within the transmission line, and that a radial stub (not shown) may also be included for impedance matching.

Reviewing, it can be seen that the Bishop's Hat antenna behaves in a slightly more complex manner than that outlined above but the same basic principles appear to hold. The low frequency performance is determined by the maximum dimension (the central length), but the high frequency responses are due to a superposition of a number of modes, including $\lambda/2$ resonance of the short edge elements and $3\lambda/2$ resonance of the longer elements.

The simulation results of both the Bishop's Hat and Circular antennas agree with the measurements and it can be seen that both the Bishop's Hat and Circular antennas are suitable for use with UWB systems. Both may be slotted to provide a band of frequencies with reduced responsiveness, for example to reduce the effect of radio interference, such as from local 802.11 transmissions.

The structures may be used in the monopole or dipole configurations, provided that they are driven in appropriately. On a PCB (printed circuit board) the increased dielectric constant (over air) results in a physically smaller antenna which suit, for example, PCMCIA applications. A balanced transmission line may be used to connect the balanced output of the transmitter a short distance to the centre of the dipole. Ceramic substrate materials may be employed to further reduce the size of the antenna structure. In an alternative structure useful in, for example, a PCMCIA-based device the shape of the (monopole or) dipole may be defined in non-copper, that is in cut-out within a ground-plane, analogously to a slotted dipole.

The above described antenna structures may be used in any UWB transmitting, receiving, or transceiving system. Some UWB applications include UWB radio communications systems, radar systems, tags, wireless local area network WLAN systems, collision avoidance sensors, RF monitoring systems, precision location systems, and the like. Embodiments of the antenna structure also have applications in non-UWB systems.

The skilled person will appreciate that many variations on the above described designs are possible. For example the antenna structure may be provided with a crenelated or undulating edge in order to give the antenna a more inductive appearance and thus shift the response of the antenna in frequency.

No doubt many effective alternatives will occur to the skilled person. It will be understood that the invention is not limited to the described embodiments and encompasses modifications apparent to those skilled in the art, lying within the spirit and scope of the claims appended hereto.

We claim:

1. An ultrawideband antenna structure comprising a planar conductor of substantially uniform resistance, the structure having the shape of a pair of conjoined generally triangular figures each with a long side, a short side and a curved side, with an antenna feed connection at one corner, the structure having an axis of symmetry passing through said antenna feed connection.

2. An ultrawideband antenna structure as claimed in claim 1 wherein said structure comprises a first pair of substantially straight sides diverging from said antenna feed connection, and a second pair of curved sides which converge towards a point opposite said antenna feed connection, said axis of symmetry defining two halves of said structure, each half of said structure having said substantially straight side and said curved side.

3. An ultrawideband antenna structure as claimed in claim 2 wherein said generally triangular figures are joined along their long sides.

4. An ultrawideband antenna structure as claimed in claim 2 wherein a said substantially straight side is at an angle of less than 60 degrees to said axis of symmetry; preferably at an angle of substantially equal to 45 degrees.

5. An ultrawideband antenna structure as claimed in claim 1 wherein a said curved side is defined by a curve comprising a portion of a locus of points for which the inverse of distance of a point from said antenna feed connection is substantially proportional to an angle between a line joining the point to said antenna feed connection and said axis of symmetry.

6. An ultrawideband antenna structure as claimed in claim 1 further comprising one or more pairs of edges each extending between said antenna feed connection and a said curved side thereby defining one or more notches in said structure.

7. An ultrawideband antenna structure as claimed in claim 1 wherein said antenna structure comprises a conducting metal layer on a circuit board.

8. An antenna comprising a substantially matched pair of antenna structures as claimed in claim 1.

9. An antenna as claimed in claim 8 wherein said antenna structures are substantially no more than 1 mm apart.

10. An antenna as claimed in claim 8 further comprising an antenna feed coupled to said antenna feed connections of said antenna structures, and wherein the antenna feed points of said antenna structures are substantially adjacent and on opposite sides of said antenna feed.

11. An antenna as claimed in claim 10 wherein said feed comprises a balanced feed.

12. An antenna structure comprising a substantially uniform resistance planar conductor with an antenna feed, the structure having the shape of a pair of conjoined generally triangular figures each with a long side, a short side and a curved side, the structure having an axis of symmetry passing through said antenna feed, and wherein said structure has a first pair of substantially straight sides diverging from said antenna feed, and a second pair of curved sides which converge towards a point opposite said antenna feed.

13. An antenna structure as claimed in claim 12 wherein the antenna structure has first and second 3 dB frequencies, said first and second 3 dB frequencies being frequencies at which when acting as a receive antenna for a signal having a substantially flat spectrum between said first and second 3 dB frequencies received signal power is 3 dB less than a maximum received signal power, and wherein said second 3 dB frequency is at least 1.5 times said first 3 dB frequency, more preferably at least 2, 2.5 or 3 times said first frequency.

14. An ultrawideband antenna, the antenna comprising an antenna body having an antenna feed, wherein said antenna body is flat and circular, the antenna further comprising a ground plane adjacent said feed, wherein said ground plane is substantially perpendicular to said antenna body, and wherein said antenna body has at least one notch.

15. An ultrawideband antenna as claimed in claim 14 wherein said antenna body has a symmetrical pair of notches.

16. An ultrawideband antenna, the antenna comprising a pair of antenna bodies in dipole configuration, said antenna bodies having an antenna feed, each said antenna body being flat and circular and defining a plane, and wherein said planes of said antenna bodies are twisted with respect to one another such that said antenna bodies do not lie in the same plane.

17. An ultrawideband antenna, as claimed in claim 16 wherein said planes of said antenna bodies are at substantially 90 degrees to one another.

18. An ultrawideband antenna, the antenna comprising an antenna body having an antenna feed, said antenna body comprising a ground plane defining an aperture having a cross-section comprising a substantially circular non-conducting disc, wherein said antenna feed comprises a slot connected to said aperture; and wherein said antenna further comprises a transmission line for driving said slot, said transmission line being substantially perpendicular to said slot.

19. An ultrawideband antenna structure comprising a planar conductor of substantially uniform resistance, the structure defining an aperture having the shape of a pair of conjoined generally triangular figures each with a long side, a short side and a curved side, with an antenna feed connection at one corner, the structure having an axis of symmetry passing through said antenna feed connection.

20. An ultrawideband antenna, the antenna comprising an antenna body having an antenna feed, said antenna body comprising a ground plane defining an aperture having a cross-section comprising a substantially circular non-conducting disc; and wherein said aperture lacks a driven conducting element within said aperture.

* * * * *